US006016868A

United States Patent [19]

Gregoli et al.

[11] Patent Number: 6,016,868

[45] Date of Patent: Jan. 25, 2000

[54] PRODUCTION OF SYNTHETIC CRUDE OIL FROM HEAVY HYDROCARBONS RECOVERED BY IN SITU HYDROVISBREAKING

[75] Inventors: Armand A. Gregoli, Tulsa; Daniel P. Rimmer, Broken Arrow, both of Okla.

[73] Assignee: World Energy Systems, Incorporated, Fort Worth, Tex.

[21] Appl. No.: 09/103,590

[22] Filed: Jun. 24, 1998

[51] Int. Cl.[7] ..... E21B 43/24

[52] U.S. Cl. ..... 166/261; 166/59; 166/267

[58] Field of Search ..... 166/57, 59, 256, 166/261, 267, 302, 303

[56] References Cited

U.S. PATENT DOCUMENTS

| | | |
|---|---|---|
| 2,506,853 | 5/1950 | Berg et al. . |
| 2,584,606 | 2/1952 | Merriam et al. . |
| 2,734,578 | 2/1956 | Walter . |
| 2,857,002 | 10/1958 | Pevere et al. . |
| 2,887,160 | 5/1959 | De Priester et al. . |
| 3,051,235 | 8/1962 | Banks . |
| 3,084,919 | 4/1963 | Slater . |
| 3,102,588 | 9/1963 | Fisher . |
| 3,208,514 | 9/1965 | Dew et al. . |
| 3,228,467 | 1/1966 | Schlinger et al. . |
| 3,254,721 | 6/1966 | Smith . |
| 3,327,782 | 6/1967 | Hujsak . |
| 3,372,754 | 3/1968 | McDonald . |
| 3,456,721 | 7/1969 | Smith . |
| 3,595,316 | 7/1971 | Myrick, III . |
| 3,598,182 | 8/1971 | Justheim . |
| 3,617,471 | 11/1971 | Schlinger et al. . |
| 3,700,035 | 10/1972 | Lange ..... 166/261 |
| 3,707,189 | 12/1972 | Prats . |
| 3,908,762 | 9/1975 | Redford . |
| 3,982,591 | 9/1976 | Hamrick et al. . |
| 3,982,592 | 9/1976 | Hamrick et al. . |
| 3,986,556 | 10/1976 | Haynes . |
| 3,990,513 | 11/1976 | Perch . |
| 3,994,340 | 11/1976 | Anderson et al. . |
| 4,024,912 | 5/1977 | Hamrick et al. . |
| 4,037,658 | 7/1977 | Anderson . |
| 4,050,515 | 9/1977 | Hamrick et al. . |
| 4,053,015 | 10/1977 | Hamrick et al. . |
| 4,077,469 | 3/1978 | Hamrick et al. . |
| 4,078,613 | 3/1978 | Hamrick et al. . |
| 4,099,568 | 7/1978 | Allen . |
| 4,127,171 | 11/1978 | Allen . |
| 4,141,417 | 2/1979 | Schora et al. . |
| 4,148,358 | 4/1979 | Compton . |
| 4,159,743 | 7/1979 | Rose et al. . |
| 4,160,479 | 7/1979 | Richardson et al. . |
| 4,183,405 | 1/1980 | Magnie . |
| 4,186,800 | 2/1980 | Allen . |
| 4,199,024 | 4/1980 | Rose et al. . |
| 4,233,166 | 11/1980 | Allen . |

(List continued on next page.)

*Primary Examiner*—Roger Schoeppel

[57] ABSTRACT

An integrated process is disclosed for treating, at the surface, production fluids recovered from the application of in situ hydrovisbreaking to heavy crude oils and natural bitumens deposited in subsurface formations. The production fluids include virgin heavy hydrocarbons, heavy hydrocarbons converted via the hydrovisbreaking process to lighter liquid hydrocarbons, residual reducing gases, hydrocarbon gases, and other components. In the process of this invention, the hydrocarbons in the production fluids are separated into a synthetic-crude-oil product (a nominal butane to 975° F. fraction with reduced sulfur, nitrogen, metals, and carbon residue) and a residuum stream (a nominal 975° F.+ fraction). Partial oxidation of the residuum is carried out to produce clean reducing gas and fuel gas for steam generation, with the reducing gas and steam used in the in situ hydrovisbreaking process.

11 Claims, 5 Drawing Sheets

U.S. PATENT DOCUMENTS 4,241,790 12/1980 Magnie .
4,265,310 5/1981 Britton et al. .
4,284,139 8/1981 Sweany .
4,324,139 4/1982 Wong et al. .
4,444,257 4/1984 Stine .
4,448,251 5/1984 Stine .
4,476,927 10/1984 Riggs .
4,487,264 12/1984 Hyne et al. .
4,501,445 2/1985 Gregoli .
4,597,441 7/1986 Ware et al. .
4,691,771 9/1987 Ware et al. .
4,865,130 9/1989 Ware et al. .
5,054,551 10/1991 Duerksen .
5,055,030 10/1991 Schirmer ..... 166/59 X
5,105,887 4/1992 Hewgill et al. .
5,145,003 9/1992 Kuerksen .
5,163,511 11/1992 Amundson et al. .

PRODUCTION OF SYNTHETIC CRUDE OIL FROM HEAVY HYDROCARBONS RECOVERED BY IN SITU HYDROVISBREAKING

BACKGROUND OF THE INVENTION

1. Field of the Invention

This invention relates to an integrated process, which treats at the surface, fluids recovered from a subsurface formation containing heavy crude oil or natural bitumen to produce a synthetic crude oil and also to produce the energy and reactants used in the recovery process. The quality of the treated oil is improved to such an extent that it is a suitable feedstock for transportation fuels and gas oil.

2. Description of the Prior Art

Worldwide deposits of natural bitumens (also referred to as "tar sands") and heavy crude oils are estimated to total more than five times the amount of remaining recoverable reserves of conventional crude [References 1,5]. But these resources (herein collectively called "heavy hydrocarbons") frequently cannot be recovered economically with current technology, due principally to the high viscosities which they exhibit in the porous subsurface formations where they are deposited. Since the rate at which a fluid flows in a porous medium is inversely proportional to the fluid's viscosity, very viscous hydrocarbons lack the mobility required for economic production rates.

In addition to high viscosity, heavy hydrocarbons often exhibit other deleterious properties which cause their upgrading into marketable products to be a significant refining challenge. These properties are compared in Table 1 for an internationally-traded light crude, Arabian Light, and three heavy hydrocarbons.

The high levels of undesirable components found in the heavy hydrocarbons shown in Table 1, including sulfur, nitrogen, metals, and Conradson carbon residue, coupled with a very high bottoms yield, require costly refining processing to convert the heavy hydrocarbons into product streams suitable for the production of transportation fuels.

TABLE 1

Properties of Heavy Hydrocarbons Compared to a Light Crude

| | Light Crude | Heavy Hydrocarbons | | |
|---|---|---|---|---|
| Properties | Arabian Light | Orinoco | Cold Lake | San Miguel |
| Gravity, °API | 34.5 | 8.2 | 11.4 | −2 to 0 |
| Viscosity, cp @ 100° F. | 10.5 | 7,000 | 10,700 | >1,000,000 |
| Sulfur, wt % | 1.7 | 3.8 | 4.3 | 7.9 to 9.0 |
| Nitrogen, wt % | 0.09 | 0.64 | 0.45 | 0.36 to 0.40 |
| Metals, wppm | 25 | 559 | 265 | 109 |
| Bottoms (975° F.+), vol % | 15 | 59.5 | 51 | 71.5 |
| Conradson carbon residue, wt % | 4 | 16 | 13.1 | 24.5 |

Converting heavy crude oils and natural bitumens to upgraded liquid hydrocarbons while still in a subsurface formation would address the two principal shortcomings of these heavy hydrocarbon resources—the high viscosities which heavy hydrocarbons exhibit even at elevated temperatures and the deleterious properties which make it necessary to subject them to costly, extensive upgrading operations after they have been produced. However, the process conditions employed in refinery units to upgrade the quality of liquid hydrocarbons would be extremely difficult to achieve in the subsurface. The injection of catalysts would be exceptionally expensive, the high temperatures used would cause unwanted coking in the absence of precise control of hydrogen partial pressures and reaction residence time, and the hydrogen partial pressures required could cause random, unintentional fracturing of the formation with a potential loss of control over the process.

A process occasionally used in the recovery of heavy crude oil and natural bitumen which to some degree converts in the subsurface heavy hydrocarbons to lighter hydrocarbons is in situ combustion. In this process an oxidizing fluid, usually air, is injected into the hydrocarbon-bearing formation at a sufficient temperature to initiate combustion of the hydrocarbon. The heat generated by the combustion warms other portions of the heavy hydrocarbon and converts a part of it to lighter hydrocarbons via uncatalyzed thermal cracking, which may induce sufficient mobility in the hydrocarbon to allow practical rates of recovery.

While in situ combustion is a relatively inexpensive process, it has major drawbacks. The high temperatures in the presence of oxygen which are encountered when the process is applied cause coke formation and the production of olefins and oxygenated compounds such as phenols and ketones, which in turn cause major problems when the produced liquids are processed in refinery units. Commonly, the processing of products from thermal cracking is restricted to delayed or fluid coking because the hydrocarbon is degraded to a degree that precludes processing by other methods.

U.S. patents, discussed below, disclose various processes for conducting in situ conversion of heavy hydrocarbons without reliance on in situ combustion. The more promising processes teach the use of downhole apparatus to achieve conditions within hydrocarbon-bearing formations to sustain what we designate as "in situ hydrovisbreaking," conversion reactions within the formation which result in hydrocarbon upgrading similar to that achieved in refinery units through catalytic hydrogenation and hydrocracking.

However, as a stand-alone process, in situ hydrovisbreaking has several drawbacks:

- Analytic studies, presented in examples to follow, show that only partial conversion of the heavy hydrocarbon is achieved in situ, with the result that the liquid hydrocarbons produced might not be used in conventional refinery operations without further processing.
- In addition to the liquid hydrocarbons of interest, significant quantities of fluids are produced which are deleterious.
- The in situ process requires vast quantities of steam and reducing gases, which are injected into the subsurface formation to create the conditions required to initiate and sustain the conversion reactions. These injectants must be supplied at minimum cost for the overall process to be economic.

The present invention concerns a process conducted at the surface which treats the raw production recovered from the application of in situ hydrovisbreaking to a heavy-hydrocarbon deposit. The process of this invention produces a synthetic crude oil (or "syncrude") with a nominal boiling range of butane ($C_4$) to 975° F., making it a suitable feedstock for transportation fuels and gas oil. The process also produces a heavy residuum stream (a nominal 975° F.+ fraction) which is processed further to produce the energy and reactants required for the application of in situ hydrovisbreaking.

Following is a review of the prior art as related to the operations relevant to this invention. The patents referenced teach or suggest the use of a downhole apparatus for in situ operations, procedures for effecting in situ conversion of heavy crudes and bitumens, and methods for recovering and processing the produced hydrocarbons.

Some of the best prior art disclosing the use of downhole devices for secondary recovery is found in U.S. Pat. Nos. 4,159,743; 5,163,511; 4,865,130; 4,691,771; 4,199,024; 4,597,441; 3,982,591; 3,982,592; 4,024,912; 4,053,015; 4,050,515; 4,077,469; and 4,078,613. Other expired patents which also disclose downhole generators for producing hot gases or steam are U.S. Pat. Nos. 2,506,853; 2,584,606; 3,372,754; 3,456,721; 3,254,721; 2,887,160; 2,734,578; and 3,595,316.

The concept of separating produced secondary crude oil into hydrogen, lighter oils, etc. and the use of hydrogen for in situ combustion and downhole steaming operations to recover hydrocarbons are found in U.S. Pat. Nos. 3,707,189; 3,908,762; 3,986,556; 3,990,513; 4,448,251; 4,476,927; 3,051,235; 3,084,919; 3,208,514; 3,327,782; 2,857,002; 4,444,257; 4,597,441; 4,241,790; 4,127,171; 3,102,588; 4,324,291; 4,099,568; 4,501,445; 3,598,182; 4,148,358; 4,186,800; 4,233,166; 4,284,139; 4,160,479; and 3,228,467. Additionally, in situ hydrogenation with hydrogen or a reducing gas is taught in U.S. Pat. Nos. 5,145,003; 5,105,887; 5,054,551; 4,487,264; 4,284;139; 4,183,405; 4,160,479; 4,141,417; 3,617,471; and 3,228,467.

U.S. Pat. No. 3,598,182 to Justheim; U.S. Pat. No. 3,327,782 to Hujsak; U.S. Pat. No. 4,448,251 to Stine; U.S. Pat. No. 4,501,445 to Gregoli; and U.S. Pat. No. 4,597,441 to Ware all teach variations of in situ hydrogenation which more closely resemble the current invention:

Justheim, U.S. Pat. No. 3,327,782 modulates (heats or cools) hydrogen at the surface. In order to initiate the desired objectives of "distilling and hydrogenation" of the in situ hydrocarbon, hydrogen is heated on the surface for injection into the hydrocarbon-bearing formation.

Hujsak, U.S. Pat. No. 4,448,251 teaches that hydrogen is obtained from a variety of sources and includes the heavy oil fractions from thc produced oil which can be used as reformer fuel. Hujsak also includes and teaches the use of forward or reverse in situ combustion as a necessary step to effect the objectives of the process. Furthermore, heating of the injected gas or fluid is accomplished on the surface, an inefficient means of heating compared to using a downhole combustion unit because of heat losses incurred during transportation of the heated fluids to and down the borehole.

Stine, U.S. Pat. No. 4,448,251 utilizes a unique process which incorporates two adjacent, non-communicating reservoirs in which the heat or thermal energy used to raise the formation temperature is obtained from the adjacent reservoir. Stine utilizes in situ combustion or other methods to initiate the oil recovery process. Once reaction is achieved, the desired source of heat is from the adjacent zone.

Gregoli, U.S. Pat. No. 4,501,445 teaches that a crude formation is subjected to fracturing to form "an underground space suitable as a pressure reactor," in situ hydrogenation, and conversion utilizing hydrogen and/or a hydrogen donor solvent, recovery of the converted and produced crude, separation at the surface into various fractions, and utilization of the heavy residual fraction to produce hydrogen for re-injection. Heating of the injected fluids is accomplished on the surface which, as discussed above, is an inefficient process.

Ware, U.S. Pat. No. 4,597,441 describes in situ "hydrogenation" (defined as the addition of hydrogen to the oil without cracking) and "hydrogenolysis" (defined as hydrogenation with simultaneous cracking). Ware teaches the use of a downhole combustor. Reference is made to previous patents relating to a gas generator of the type disclosed in U.S. Pat. Nos. 3,982,591; 3,982,592; or 4,199,024. Ware further teaches and claims injection from the combustor of superheated steam and hydrogen to cause hydrogenation of petroleum in the formation. Ware also stipulates that after injecting superheated steam and hydrogen, sufficient pressure is maintained "to retain the hydrogen in the heated formation zone in contact with the petroleum therein for 'soaking' purposes for a period of time." In some embodiments Ware includes combustion of petroleum products in the formation—a major disadvantage, as discussed earlier—to drive fluids from the injection to the production wells.

None of these patents disclose an integrated process in which heavy hydrocarbons are converted in situ to lighter hydrocarbons by injecting steam and hot reducing gases with the produced hydrocarbons separated at the surface into various fractions and the residuum fraction diverted for the production of reducing gas and steam while the lighter hydrocarbon fractions are marketed as a source for transportation fuels and gas oil.

Another group of U.S. patents—including U.S. Pat. Nos. 5,145,003 and 5,054,551 to Duerksen; U.S. Pat. No. 4,160,479 to Richardson; U.S. Pat. No. 4,284,139 to Sweany; U.S. Pat. No. 4,487,264 to Hyne; and U.S. Pat. No. 4,141,417 to Schora—all teach variations of hydrogenation with heating of the injected fluids (hydrogen, reducing gas, steam, etc.) accomplished at the surface. Further:

Richardson, U.S. Pat. No. 4,160,479 teaches the use of a produced residuum fraction as a feed to a gasifier for the production of energy; i.e., power, steam, etc. Hot gases produced are available for injection at a pressure of 150 atmospheres and temperatures between 800 and 1,000° C. Hydrogen and oxygen are produced by electrolytic hydrolysis of water.

Sweany, U.S. Pat. No. 4,284,139 teaches the use of a produced residuum fraction (pitch) which is subjected to partial oxidation to produce hydrogen and steam. Sweany utilizes surface upgrading accomplished in the presence of a hydrogen donor on the surface.

Hyne, U.S. Pat. No. 4,487,264 injects steam at a temperature of 260° C. or less to promote the water-gas-shift reaction to form in situ carbon dioxide and hydrogen. Hyne claims that the long-term exposure of heavy oil to polymerization, degradation, etc. is reduced due to the formation hydrocarbon's exposure to less elevated temperatures.

Schora, U.S. Pat. No. 4,141,417 injects hydrogen and carbon dioxide at a temperature of less than 300° F. and claims to reduce the hydrocarbon formation viscosity and accomplish desulfurization. Viscosity reduction is assumed primarily through the well-known mechanism involving solution of carbon dioxide in the hydrocarbon.

In addition to not using a downhole combustion unit for injection of hot reducing gases, none of these patents includes the processing of a syncrude product with the properties claimed in this invention. Most importantly, none of the patents referenced herein includes the unique and novel integration of in situ hydrovisbreaking with the operations comprising in this invention.

All of the U.S. patents mentioned are fully incorporated herein by reference thereto as if fully repeated verbatim immediately hereafter.

In light of the current state of the technology, what is needed—and what has been discovered by us—is a unique process for producing valuable petroleum products, such as syncrude boiling in the transportation-fuel range ($C_4$ to 650° F.) and gas-oil range (650 to 975° F.) from the raw production of heavy crudes and bitumens with the energy and reactants used in the recovery operation produced from the less desirable components of the raw production. The process disclosed in this invention minimizes the amount of surface processing required to produce marketable petroleum products while permitting the production and utilization of hydrocarbon resources which are otherwise not economically recoverable.

Objectives of the Invention

The primary objective of this invention is to provide a process for producing a synthetic crude oil that is a suitable feedstock for transportation fuels and gas oil from the raw production of heavy crude oils and natural bitumens recovered by the application in situ hydrovisbreaking.

Another objective of this invention is to enhance the quality of the partially upgraded hydrocarbons produced from the formation by above-ground removal of the heavy residuum fraction and the carbon residue contained in the produced hydrocarbons. This results in the production of a more valuable syncrude product with reduced levels of sulfur, nitrogen, and metals.

The in situ hydrovisbreaking operation utilizes downhole combustion units. A further objective of this invention is to utilize the separated residuum fraction as a feedstock for a partial oxidation operation to provide clean hydrogen for combustion in the downhole combustion units and injection into the hydrocarbon-bearing formation as well as fuel gas for use in steam and electric power generation.

SUMMARY OF THE INVENTION

This invention discloses the integration of an above-ground process for preparation of a synthetic-crude-oil ("syncrude") product from the raw production resulting from the recovery of heavy crude oils and natural bitumens (collectively, "heavy hydrocarbons"), a portion of which have been converted in situ to lighter hydrocarbons during the recovery process. The conversion reactions, which may include hydrogenation, hydrocracking, desulfurization, and other reactions, are referred to herein as "hydrovisbreaking." During the application of in situ hydrovisbreaking, continuous recovery utilizing one or more injection boreholes and one or more production boreholes may be employed. Alternatively, a cyclic method using one or more individual boreholes may be utilized.

The conditions necessary for sustaining the hydrovisbreaking reactions are achieved by injecting superheated steam and hot reducing gases, comprised principally of hydrogen, to heat the formation to a preferred temperature and to maintain a preferred level of hydrogen partial pressure. This is accomplished through the use of downhole combustion units, which are located in the injection boreholes at a level adjacent to the heavy hydrocarbon formation and in which hydrogen is combusted with an oxidizing fluid while partially saturated steam and, optionally, additional hydrogen are flowed from the surface to the downhole units to control the temperature of the injected gases.

Prior to its production from the subsurface formation, the heavy hydrocarbon undergoes significant conversion and resultant upgrading in which the viscosity of the hydrocarbon is reduced by many orders of magnitude and in which its API gravity may be increased by 10 to 15 degrees or more.

After recovery from the formation, the produced hydrocarbons are subjected to surface processing, which provides further upgrading to a final syncrude product. The fraction of the produced hydrocarbons boiling above approximately 975° F. is separated via simple fractionation. Since most of the undesirable components of the produced hydrocarbons—including sulfur, nitrogen, metals and residue—are contained in this heavy residuum fraction, the remaining syncrude product has significantly improved properties. A further increase in API gravity of approximately 12 degrees is achieved in this separation step.

The residuum fraction is utilized in the process of this invention to prepare the reducing gas and fuel gas required for process operations. The residuum is converted to these intermediate products by partial oxidation. The effluent from the partial oxidation unit is treated in conventional process units to remove acid gases, metals, and residues, which are processed as byproducts.

Following is an example of the process steps for a preferred embodiment of in situ hydrovisbreaking integrated with the present invention to achieve its objectives:

a. inserting downhole combustion units within injection boreholes, which communicate with production boreholes by means of horizontal fractures, at or near the level of the subsurface formation containing a heavy hydrocarbon;

b. for a preheat period, flowing from the surface through said injection boreholes stoichiometric proportions of a reducing-gas mixture and an oxidizing fluid to said downhole combustion units and igniting same in said downhole combustion units to produce hot combustion gases, including superheated steam, while flowing partially saturated steam from the surface through said injection boreholes to said downhole combustion units to control the temperature of said heated gases and to produce additional superheated steam;

c. injecting said superheated steam into the subsurface formation to heat a region of the subsurface formation to a preferred temperature;

d. for a conversion period, increasing the ratio of reducing gas to oxidant in the mixture fed to the downhole combustion units, or injecting reducing gas in the fluid stream controlling the temperature of the combustion units, to provide an excess of reducing gas in the hot gases exiting the combustion units;

e. continuously injecting the heated excess reducing gas and superheated steam into the subsurface formation to provide preferred conditions and reactants to sustain in situ hydrovisbreaking and thereby upgrade the heavy hydrocarbon;

f. collecting continuously at the surface, from said production boreholes, production fluids comprised of converted liquid hydrocarbons, unconverted virgin heavy hydrocarbons, residual reducing gases, hydrocarbon gases, solids, water, hydrogen sulfide, and other components for further processing;

g. treating at the surface the said production fluids to recover thermal energy and to separate produced solids, gases, and produced liquid hydrocarbons;

h. fractionating the said produced liquid hydrocarbons to provide an upgraded liquid hydrocarbon product and a heavy residuum fraction;

i. carrying out partial oxidation of said residuum fraction and gas-treating operations to produce a clean reducing gas mixture and a fuel gas stream;

j. carrying out treating operations on the separated gases and residual reducing-gas mixture to remove water, hydrogen sulfide, and other undesirable components and to separate hydrocarbon gases and residual reducing gas mixture;

k. combining said reducing gas mixtures of steps i and j to form the reducing gas mixture of step b;

l. generation of steam using as fuel the combined hydrocarbon gases of step j and fuel gas of step f;

m. repeating steps d through l.

These integrated subsurface and surface operations and related auxiliary operations have been developed by World Energy Systems as the In Situ Hydrovisbreaking with Residue Elimination process (the ISHRE process).

BRIEF DESCRIPTION OF THE DRAWINGS

FIG. 5 shows for the four cases the cumulative oil recovered as a percentage of the original oil in place (OOIP) as a function of production time.

DESCRIPTION OF THE PREFERRED EMBODIMENTS

Figure 1:
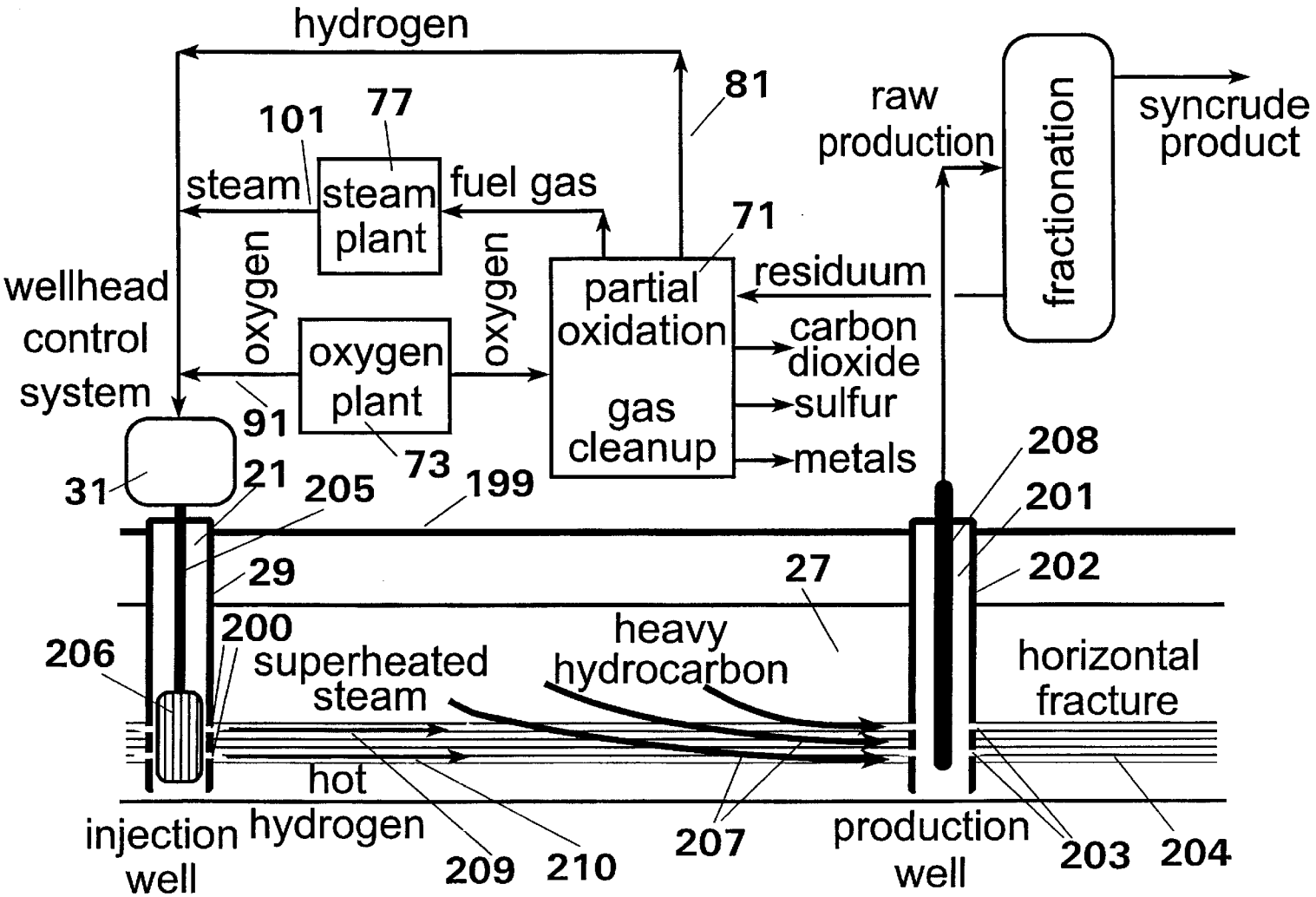
FIG. 1 is a schematic of a preferred embodiment of in situ hydrovisbreaking in which injection boreholes and production boreholes are utilized in a continuous fashion with flow of hot reducing gas and steam from the injection boreholes toward the production boreholes where upgraded heavy hydrocarbons are collected and produced. Also illustrated is a schematic of the primary features of the surface facilities of the present invention required for production of the syncrude product.

This invention discloses an above-ground process, which when coupled with in situ hydrovisbreaking is designated the ISHRE process. The process is designed to prepare a synthetic-crude-oil ("syncrude") product from heavy crude oils and natural bitumens by converting these hydrocarbons in situ and processing them further on the surface. The ISHRE process, which eliminates many of the deleterious and expensive features of the prior art, incorporates multiple steps including: (a) use of downhole combustion units to provide a means for direct injection of superheated steam and hot reactants into the hydrocarbon-bearing formation; (b) enhancing injectibility and inter-well communication within the formation via formation fracturing or related methods; (c) in situ hydrovisbreaking of the heavy hydrocarbons in the formation by establishing suitable subsurface conditions via injection of superheated steam and reducing gases; (d) production of the upgraded hydrocarbons; (e) separation of the produced hydrocarbons into a syncrude product (a hydrocarbon fraction in the $C_4$ to 975° F. range with reduced sulfur, nitrogen, and carbon residue) and a residuum stream (a nominal 975°+ fraction); and (f) use of the separated residuum to generate reducing gas and steam for in situ injection.

Very low gravity, highly viscous hydrocarbons with high levels of sulfur, nitrogen, metals, and 975° F.+ residuum are excellent candidates for the ISHRE process.

Multiple embodiments of the general concepts of this invention are included in the following description. A description of the in situ operations for conducting the hydrovisbreaking process, which are integrated with the present invention, is followed by a corresponding section for the surface operations that are the subject of the present invention.

Detailed Description of the Subsurface Facilities and Operations

The process of in situ hydrovisbreaking is designed to provide in situ upgrading of heavy hydrocarbons comparable to that achieved in surface units by modifying process conditions to those achievable within a reservoir-relatively moderate temperatures (625 to 750° F.) and hydrogen partial pressures (500 to 1,200 psi) combined with longer residence times (several days to months) in the presence of naturally occurring catalysts.

To effect hydrovisbreaking in situ, hydrogen must contact a heavy hydrocarbon in a heated region of the hydrocarbon-bearing formation for a sufficient time for the desired reactions to occur. The characteristics of the formation must be such that excessive loss of hydrogen is prevented, conversion of the heavy hydrocarbon is achieved, and sufficient recovery of the hydrocarbon occurs. Application of the process within the reservoir requires that a hydrocarbon-bearing zone be heated to a minimum temperature of 625° F. in the presence of hydrogen. Although temperatures up to 850° F. would be effective in promoting the hydrovisbreaking reactions, a practical upper limit for in situ operation is projected to be 750° F. The in situ hydrocarbons must be maintained at the desired operating conditions for a period ranging from several days to several months, with the longer residence times required for lower temperatures and hydrogen partial pressures.

The result of the hydrovisbreaking reactions is conversion of the heavier fractions of the heavy hydrocarbons to lower boiling components—with reduced viscosity and specific gravity as well as reduced concentrations of sulfur, nitrogen, and metals. For this application, conversion is measured by the disappearance of the residuum fraction in the produced hydrocarbons as a result of its reaction to lighter and more valuable hydrocarbons and is defined as:

$$\text{percent of 975° F. conversion} = 100 \times \frac{(\text{vol \% of 975° F.+ in unconverted hydrocarbon} - \text{vol \% of 975° F.+ in produced hydrocarbon})}{\text{vol \% of 975° F.+ in unconverted hydrocarbon}}$$

Under this definition, the objectives of this invention will be achieved with conversions in the 30 to 50 percent range for a heavy hydrocarbon such as the San Miguel bitumen. This level of conversion may be attained at the conditions discussed above.

To effectively heat a heavy-hydrocarbon reservoir to the minimum desired temperature of 625° F. requires the temperature of the injected fluid be at least say 650° F., which for saturated steam corresponds to a saturation pressure of 2,200 psi. An injection pressure of this magnitude could cause a loss of control over the process as the parting pressure of heavy-hydrocarbon reservoirs, which are typically found at depths of about 1,500 ft, is generally less than 1,900 psi. Therefore, it is impractical to heat a heavy-hydrocarbon reservoir to the desired temperature using saturated steam alone. Use of conventionally generated superheated steam is also impractical because heat losses in surface piping and wellbores can cause steam-generation costs to be prohibitively high.

The limitation on using steam generated at the surface is overcome in this invention by use of a downhole combustion unit, which can provide heat to the subsurface formation in a more efficient manner. In its preferred operating mode, hydrogen is combusted with oxygen with the temperature of the combustion gases controlled by injecting partially saturated steam, generated at the surface, as a cooling medium. The superheated steam resulting from using partially saturated steam to absorb the heat of combustion in the combustion unit and the hot reducing gases exiting the combustion unit are then injected into the formation to provide the thermal energy and reactants required for the process.

Alternatively, a reducing-gas mixture—comprised principally of hydrogen with lesser amounts of carbon monoxide, carbon dioxide, and hydrocarbon gases—may be substituted for the hydrogen sent to the downhole combustion unit. A reducing-gas mixture has the benefit of requiring less purification yet still provides a means of sustaining the hydrovisbreaking reactions.

The downhole combustion unit is designed to operate in two modes. In the first mode, which is utilized for preheating the subsurface formation, the unit combusts stoichiometric amounts of reducing gas and oxidizing fluid so that the combustion products are principally superheated steam. Partially saturated steam injected from the surface as a coolant is also converted to superheated steam.

In a second operating mode, the amount of hydrogen or reducing gas is increased beyond its stoichiometric proportion (or the flow of oxidizing fluid is decreased) so that an excess of reducing gas is present in the combustion products. Alternatively, hydrogen or reducing gas is injected into the fluid stream controlling the temperature of the combustion unit. This operation results in the pressurizing of the heated subsurface region with hot reducing gas. Steam may also be injected in this operating mode to provide an injection mixture of steam and reducing gas.

The downhole combustion unit may be of any design which accomplishes the objectives stated above. Examples of the type of downhole units which may be employed include those described in U.S. Pat. Nos. 3,982,591; 4,050,515; 4,597,441; and 4,865,130.

The very high viscosities exhibited by heavy hydrocarbons limit their mobility in the subsurface formation and make it difficult to bring the injectants and the in situ hydrocarbons into intimate contact so that they may create the desired products. Solutions to this problem may take several forms: (1) horizontally fractured wells, (2) vertically fractured wells, (3) a zone of high water saturation in contact with the zone containing the heavy hydrocarbon, (4) a zone of high gas saturation in contact with the zone containing the heavy hydrocarbon, or (5) a pathway between wells created by an essentially horizontal hole, such as established by Anderson, U.S. Pat. Nos. 4,037,658 and 3,994,340.

The steps necessary to provide the conditions required for the in situ hydrovisbreaking reactions to occur may be implemented in a continuous mode, a cyclic mode, or a combination of these modes. The process may include the use of conventional vertical boreholes or horizontal boreholes. Any method known to those skilled in the art of reservoir engineering and hydrocarbon production may be utilized to effect the desired process within the required operating parameters.

Referring to the drawing labeled FIG. 1, there is illustrated a borehole 21 for an injection well drilled from the surface of the earth 199 into a hydrocarbon-bearing formation or reservoir 27. The injection-well borehole 21 is lined with steel casing 29 and has a wellhead control system 31 atop the well to regulate the flow of reducing gas, oxidant, and steam to a downhole combustion unit 206. The casing 29 contains perforations 200 to provide fluid communication between the inside of the borehole 21 and the reservoir 27.

Also in FIG. 1, there is illustrated a borehole 201 for a production well drilled from the surface of the earth 199 into the reservoir 27 in the vicinity of the injection-well borehole 21. The production-well borehole 201 is lined with steel casing 202. The casing 201 contains perforations 203 to provide fluid communication between the inside of the borehole 201 and the reservoir 27. Fluid communication within the reservoir 27 between the injection-well borehole 21 and the production-well borehole 201 is enhanced by hydraulically fracturing the reservoir in such a manner as to introduce a horizontal fracture 204 between the two boreholes.

Of interest is to inject hot gases into the reservoir 27 by way of the injection-well borehole 21 and continuously recover hydrocarbon products from the production-well borehole 201. Again in FIG. 1, located at the surface are a source 71 of fuel under pressure, a source 73 of oxidizing fluid under pressure, and a source 77 of cooling fluid under pressure. The fuel source 71 is coupled by line 81 to the wellhead control system 31. The oxidizing-fluid source 73 is coupled by line 91 to the wellhead control system 31. The cooling-fluid source 77 is coupled by line 101 to the wellhead control system 31. Through injection tubing strings 205, the three fluids are coupled to the downhole combustion unit 206. The fuel is oxidized by the oxidizing fluid in the combustion unit 206, which is cooled by the cooling fluid. The products of oxidation and the cooling fluid 209 along with any un-oxidized fuel 210, all of which are heated by the exothermic oxidizing reaction, are injected into the reservoir 27 through the perforations 200 in the casing 29. Heavy hydrocarbons 207 in the reservoir 27 are heated by the hot injected fluids which, in the presence of hydrogen, initiate hydrovisbreaking reactions. These reactions upgrade the quality of the hydrocarbons by converting their higher molecular-weight components into lower molecular-weight components which have less density, lower viscosity, and greater mobility within the reservoir than the unconverted hydrocarbons. The hydrocarbons subjected to the hydrovisbreaking reaction and additional virgin hydrocarbons flow into the perforations 203 of the casing 202 of the production-well borehole 201, propelled by the pressure of the injected fluids. The hydrocarbons and injected fluids arriving at the production-well borehole 201 are removed from the borehole using conventional oil-field technology and flow through production tubing strings 208 into the surface facilities. Any number of injection wells and production wells may be operated simultaneously while situated so as to allow the injected fluids to flow efficiently from the injection wells through the reservoir to the production wells contacting a significant portion of the heavy hydrocarbons in situ.

In the preferred embodiment, the cooling fluid is steam, the fuel used is hydrogen, and the oxidizing fluid used is oxygen, whereby the product of oxidization in the downhole combustion unit 206 is superheated steam. This unit incorporates a combustion chamber in which the hydrogen and oxygen mix and react. Preferably, a stoichiometric mixture of hydrogen and oxygen is initially fed to the unit during its operation. This mixture has an adiabatic flame temperature of approximately 5,700° F. and must be cooled by the coolant steam in order to protect the combustion unit's materials of construction. After cooling the downhole combustion unit, the coolant steam is mixed with the combustion products, resulting in superheated steam being injected into the reservoir. Generating steam at the surface and injecting it to cool the downhole combustion unit reduces the amount of hydrogen and oxygen, and thereby the cost, required to produce a given amount of heat in the form of superheated steam. The coolant steam may include liquid water as the result of injection at the surface or condensation within the injection tubing. The ratio of the mass flow of steam passing through the injection tubing 205 to the mass flow of oxidized gases leaving the combustion unit 206 affects the temperature at which the superheated steam is injected into the reservoir 27. As the reservoir becomes heated to the level necessary for the occurrence of hydrovisbreaking reactions, it is preferable that a stoichiometric excess of hydrogen be fed to the downhole combustion unit during its operation, resulting in hot hydrogen being injected into the reservoir along with superheated steam. This provides a continued heating of the reservoir in the presence of hydrogen, which are the conditions necessary to sustain the hydrovisbreaking reactions.

In another embodiment, a mixture of hydrogen and carbon monoxide may be substituted for hydrogen. This reducing-gas mixture has the benefit of requiring less purification yet provides a similar benefit in initiating hydrovisbreaking reactions in heavy crude oils and bitumens.

FIG. 1 therefore shows a hydrocarbon-production system that continuously converts, upgrades, and recovers heavy hydrocarbons from a subsurface formation traversed by one or more injection boreholes and one or more production boreholes. The system is free from any combustion operations within the subsurface formation and free from the injection of any oxidizing materials or catalysts into the subsurface formation.

Figure 2:
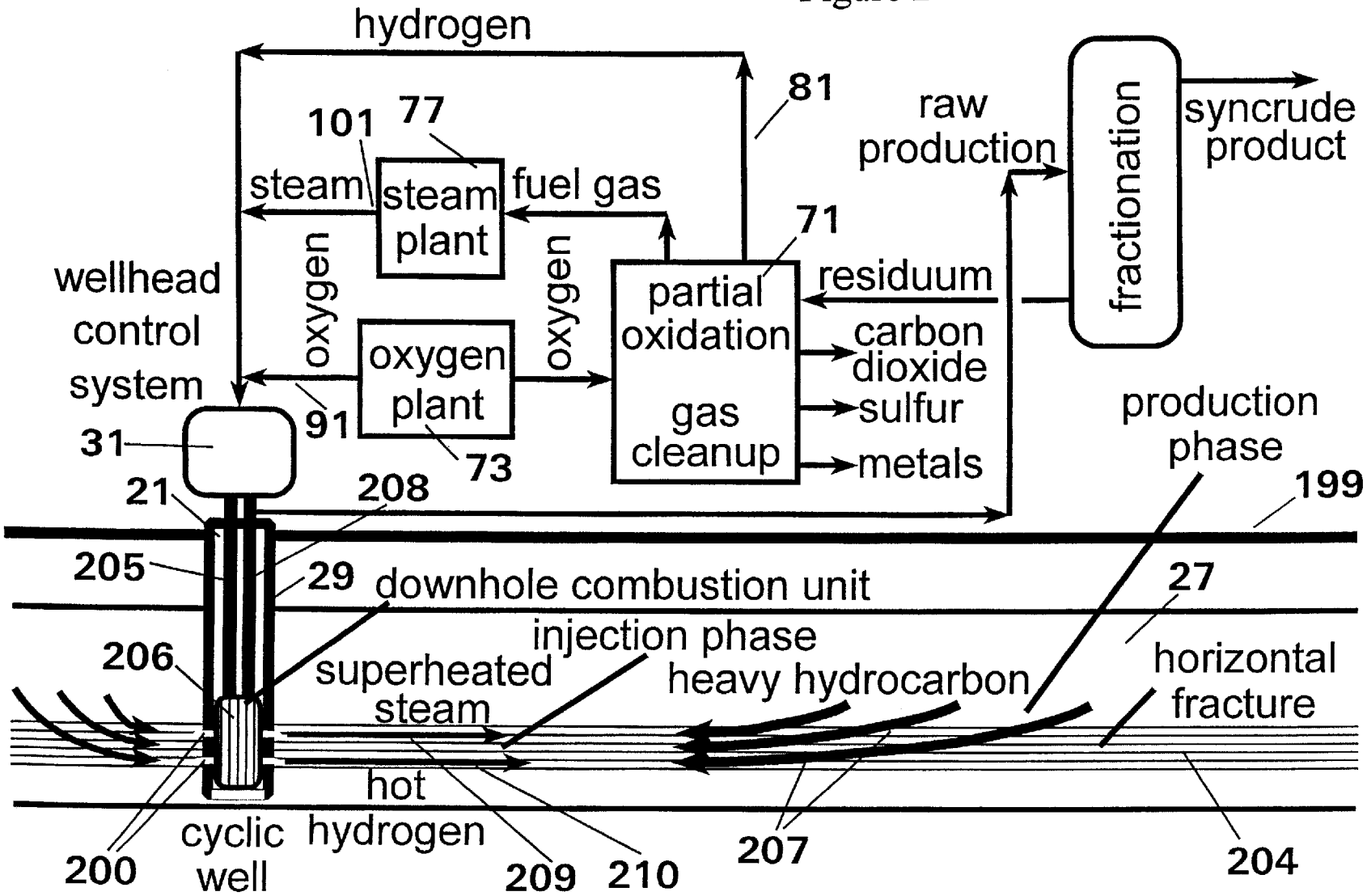
FIG. 2 is a modification of FIG. 1 in which a cyclic operating mode of in situ hydrovisbreaking is illustrated whereby both the injection and production operations occur in the same borehole, with the recovery process operated as an injection period followed by a production period. The cycle is then repeated.

Referring to the drawing labeled FIG. 2, there is illustrated a borehole 21 for a well drilled from the surface of the earth 199 into a hydrocarbon-bearing formation or reservoir 27. The borehole 21 is lined with steel casing 29 and has a wellhead control system 31 atop the well. The casing 29 contains perforations 200 to provide fluid communication between the inside of the borehole 21 and the reservoir 27.

Of interest is to cyclically inject hot gases into the reservoir 27 by way of the borehole 21 and subsequently to recover hydrocarbon products from the same borehole. Referring again to FIG. 2, located at the surface are a source 71 of fuel under pressure, a source 73 of oxidizing fluid under pressure, and a source 77 of cooling fluid under pressure. The fuel source 71 is coupled by line 81 to the wellhead control system 31. The oxidizing-fluid source 73 is coupled by line 91 to the wellhead control system 31. The cooling-fluid source 77 is coupled by line 101 to the wellhead control system 31. Through injection tubing strings 205, the three fluids are coupled to a downhole combustion unit 206. The combustion unit is of an annular configuration so tubing strings can be run through the unit when it is in place downhole. During the injection phase of the process, the fuel is oxidized by the oxidizing fluid in the combustion unit 206, which is cooled by the cooling fluid in order to protect the combustion unit's materials of construction. The products of oxidation and the cooling fluid 209 along with any un-oxidized fuel 210, all of which are heated by the exothermic oxidizing reaction, are injected into the reservoir 27 through the perforations 200 in the casing 29. The ability of the reservoir to accept injected fluids is enhanced by hydraulically fracturing the reservoir to create a horizontal fracture 204 in the vicinity of the borehole 21. As in the continuous-production process, heavy hydrocarbons 207 in the reservoir 27 are heated by the hot injected fluids which, in the presence of hydrogen, initiate hydrovisbreaking reactions. These reactions upgrade the quality of the hydrocarbons by converting their higher molecular-weight components into lower molecular-weight components which have less density lower viscosity, and greater mobility within the reservoir than the unconverted hydrocarbons. At the conclusion of the injection phase of the process, the injection of fluids is suspended. After a suitable amount of time has elapsed, the production phase begins with the pressure at the wellhead 31 reduced so that the pressure in the reservoir 27 in the vicinity of the borehole 21 is higher than the pressure at the wellhead. The hydrocarbons subjected to the hydrovisbreaking reaction, additional virgin hydrocarbons, and the injected fluids flow into the perforations 200 of the casing 29 of the borehole 21, propelled by the excess reservoir pressure in the vicinity of the borehole. The hydrocarbons and injected fluids arriving at the borehole 21 are removed from the borehole using conventional oil-field technology and flow through production tubing strings 208 into the surface facilities. Any number of wells may be operated simultaneously in a cyclic fashion while situated so as to allow the injected fluids to flow efficiently through the reservoir to contact a significant portion of the heavy hydrocarbons in situ.

As with the continuous-production process illustrated in FIG. 1, in the preferred embodiment the cooling fluid is steam, the fuel used is hydrogen, and the oxidizing fluid used is oxygen. Preferably, a stoichiometric mixture of hydrogen and oxygen is initially fed to the downhole combustion unit 206 so that the sole product of combustion is superheated steam. As the reservoir becomes heated to the level necessary for the occurrence of hydrovisbreaking reactions, it is preferable that a stoichiometric excess of hydrogen be fed to the downhole combustion unit during its operation, resulting in hot hydrogen being injected into the reservoir along with superheated steam. This provides a continued heating of the reservoir in the presence of hydrogen, which are the conditions necessary to sustain the hydrovisbreaking reactions.

As with the continuous-production process, in another embodiment of the cyclic process a mixture of hydrogen and carbon monoxide may be substituted for hydrogen.

FIG. 2 therefore shows a hydrocarbon-production system that cyclically converts, upgrades, and recovers heavy hydrocarbons from a subsurface formation traversed by one or more boreholes. The system is free from any combustion operations within the subsurface formation and free from the injection of any oxidizing materials or catalysts into the subsurface formation.

Detailed Description of the Surface Facilities and Operations

Figure 3:
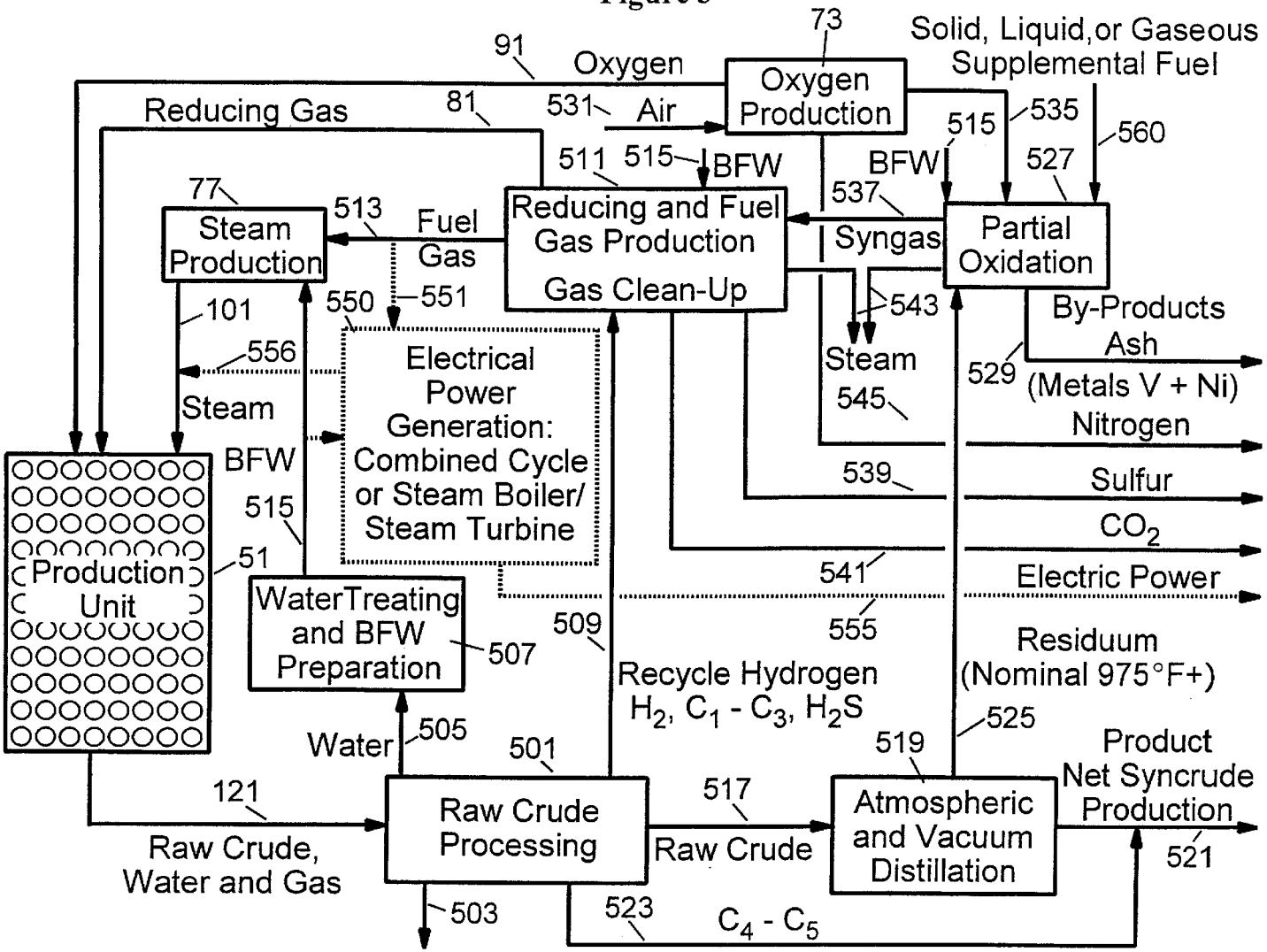
FIG. 3 illustrates the integration of in situ hydrovisbreaking and the process of this invention with emphasis on the surface facilities. This figure shows the primary units necessary for separation of the produced fluids to create the syncrude product and for generation of the reducing gas, steam and fuel gas needed for in situ operations. An embodiment including the production of electric power is also shown.

Referring now to FIG. 3, there will be described the surface system of the present invention for processing the raw liquid hydrocarbons (raw crude), water, and gas obtained from the production wells. The reference numerals in FIG. 3 that are the same as those in FIG. 1 identify components also appearing in FIG. 1. Injection and production wells in FIG. 3 are shown collectively as a production unit, referenced as 51. The raw crude, water and gas production from line 121 is fed to a raw crude processing system 501 which separates the BSW (bottom sediment and water), light hydrocarbon liquids such as butane and pentane ($C_4$–$C_5$), and gases including hydrogen ($H_2$), light hydrocarbons ($C_1$–$C_3$), and hydrogen sulfide ($H_2S$) from the raw crude. System 501 consists of a series of heat exchangers and separation vessels. The BSW stream is fed by line 503 to a disposal unit. The production water separated in unit 501 is fed by line 505 to a water treating and boiler feed water (BFW) preparation system 507. The separated $H_2$, $C_1$–$C_3$, and $H_2S$ are fed by line 509 to a gas clean-up unit 511 in which hydrogen sulfide and other contaminants are removed in absorption processes. Fuel gas from unit 511 is fed by line 513 to the steam production system 77 which consists or one or more fired boilers. BFW is fed from unit 507 by way of line 515 to the steam production unit 77 for the production of steam, which is fed by line 101 to the production unit 51.

The raw crude separated in unit 501 is fed by line 517 to an atmospheric and vacuum distillation system 519 which produces the syncrude product that is fed by line 521 to product storage and shipping facilities. The separated $C_4$–$C_5$ liquids are fed by line 523 to line 521 where they are added to the net syncrude product stream.

The residuum separated from the raw crude in unit 519 is fed by line 525 to a partial oxidation system 527 where it is oxidized and converted to a mixture of $H_2$, $H_2S$, carbon monoxide (CO), carbon dioxide ($CO_2$), and other components. An oxygen plant 73 receives air from line 531 and produces oxygen which is fed by line 91 to the downhole combustion units 206 (FIG. 1) and by line 535 to the partial oxidation system 527. Separated ash, including metals such as vanadium and nickel, is fed from unit 527 by line 529 to disposal or alternatively to process units for recovery of byproducts. The synthesis gas ("syngas") product, including the mixture of $H_2$, CO, and other gases generated in the partial oxidation unit, is fed by line 537 to the reducing gas production/fuel gas production/gas clean-up unit 511. This unit serves several functions including removal of $CO_2$, $H_2S$, water and other components from the syngas stream; conversion of a portion of the CO in the syngas to $H_2$ via the water-gas-shift reaction; concentration of the hydrogen stream for embodiments requiring purified $H_2$; and conversion of $H_2S$ to elemental sulfur using conventional technology. The resulting sulfur and $CO_2$ streams are fed by lines 539 and 541 to by-product handling and disposal. Boiler feed water 515 is fed to the partial oxidation and gas clean-up units for heat recovery, and the resulting steam is made available in lines 543 for process utilization. Nitrogen removed from the air fed to unit 73 is fed by line 545 to disposal or use as a by-product.

In another embodiment, solid, liquid, or gaseous fuels may also be fed via line 560 to the partial oxidation unit 527 to supplement the residuum feed 525 fed to unit 527. Use of supplemental fuels reduces the quantity of residuum 525 required for feed to unit 527 and thereby increases the total quantity of syncrude product 521.

Figure 4:
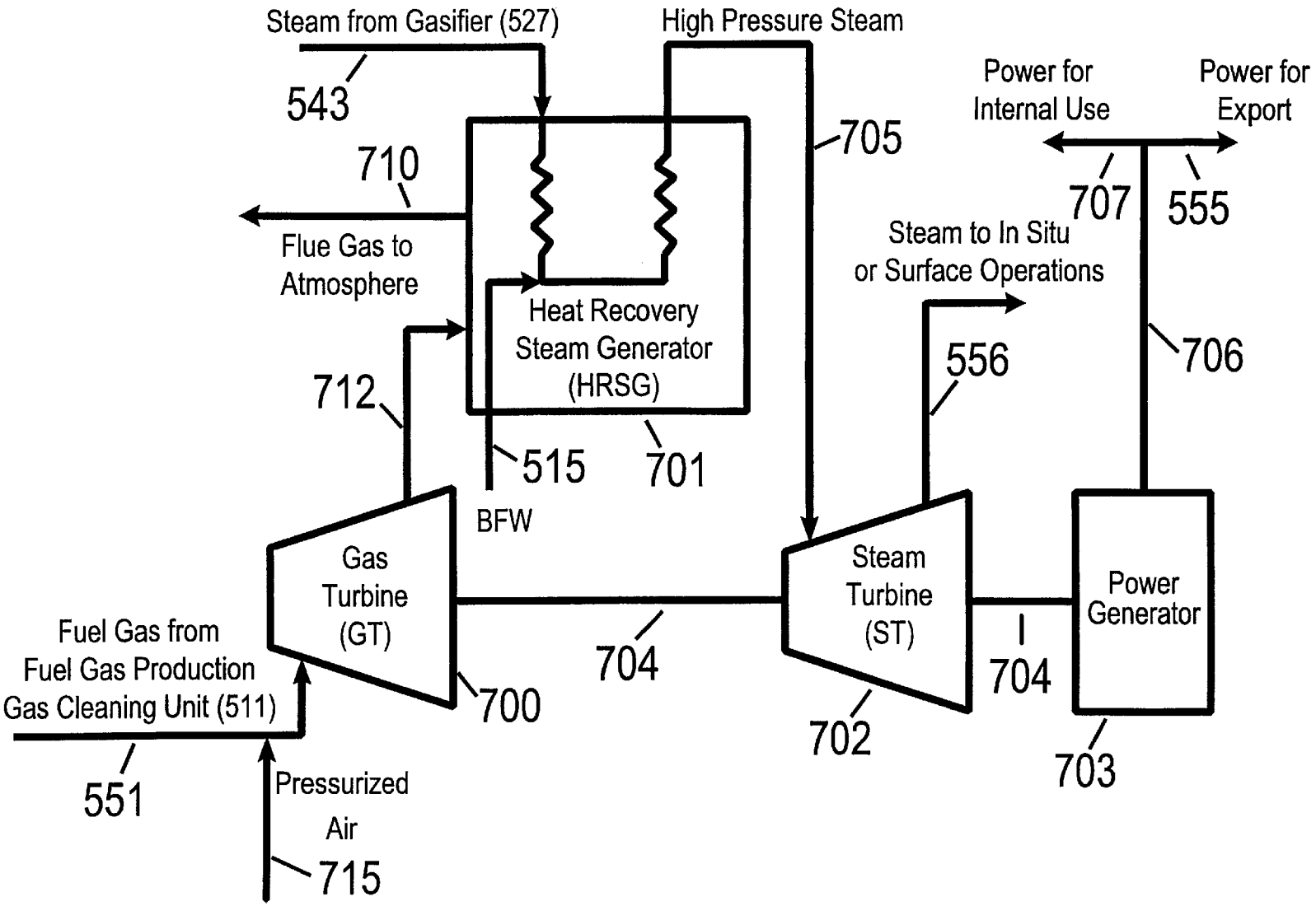
FIG. 4 is a more detailed schematic of a surface facility used for generation of electric power via a combined cycle process.

In an additional embodiment of the invention a portion of the energy produced by the partial oxidation of the residuum stream 525 of FIG. 3 in the form of fuel gas is utilized to generate electric power for internal consumption or for sale as a product of the process. The combined cycle unit 550 shown in FIG. 3 is further illustrated in FIG. 4. (Alternatively, a steam boiler and steam-turbine generation unit may be utilized.) Referring to FIG. 4, a portion of the clean fuel gas 513 produced in the reducing gas production/fuel gas production/gas clean-up unit 511 is mixed with pressurized air 715 and fed via line 551 to a gas turbine 700 where it is combusted and expanded through the turbine blades to provide power via shaft 704. The hot gases 712 exiting the gas turbine are fed to a heat recovery steam generator (HRSG) unit 701 where thermal energy in these gases is recovered by superheating steam 543 generated in the partial oxidation unit 527 (FIG. 3). Boiler feed water 515 may also be fed to the HRGS to raise additional steam. The cooled flue gas 710 exiting the HRGS is vented to the atmosphere. High-pressure steam 705 exiting the HRGS is then expanded through steam turbine (ST) 702 to provide additional power to shaft 704. Low-pressure steam 556 leaving the ST may be utilized for in situ or surface process requirements. The mechanical energy of rotating shaft 704 is use by power generator 703 to generate electrical power 706 which may then be directed to power for export 555 or to power for internal use 707.

EXAMPLE I

Hydrovisbreaking Upgrades Many Heavy Crudes and Bitumens

Example I illustrates the upgrading of a wide range of heavy hydrocarbons that can be achieved through hydrovisbreaking, as confirmed by bench-scale tests. Hydrovisbreaking tests were conducted by World Energy Systems on four heavy crude oils and five natural bitumens [Reference 8]. Each sample tested was charged to a pressure vessel and allowed to soak in a hydrogen atmosphere at a constant pressure and temperature. In all cases, pressure was maintained below the parting pressure of the reservoir from which the hydrocarbon sample was obtained. Temperature and hydrogen soak times were varied to obtain satisfactory results, but no attempt was made to optimize process conditions for the individual samples.

Table 2 lists the process conditions of the tests and the physical properties of the heavy hydrocarbons before and after the application of hydrovisbreaking. As shown in Table 2, hydrovisbreaking caused exceptional reductions in viscosity and significant reductions in molecular weight (as indicated by API gravity) in all samples tested. Calculated atomic carbon/hydrogen (C/H) ratios were also reduced in all cases.

TABLE 2

Conditions and Results from Hydrovisbreaking Tests on Heavy Hydrocarbons (Example I)

| Crude/Bitumen Location | Kern River California | Unknown California | San Miguel Texas | Slocum Texas | Asphalt Ridge Utah | Tar Sands Triangle Utah | Athabasca Alberta | Cold Lake Alberta | Primrose Alberta |
|---|---|---|---|---|---|---|---|---|---|
| Test Conditions | | | | | | | | | |
| Temperature, ° F. | 650 | 625 | 650 | 700 | 650 | 650 | 650 | 650 | 600 |
| $H_2$ Pressure, psi | 1,000 | 2,600 | 1,000 | 1,000 | 900 | 1,000 | 1,000 | 1,500 | 1,000 |
| Soak Time, days | 10 | 14 | 11 | 7 | 8 | 10 | 3 | 2 | 9 |
| Properties Before and After Hydrovisbreaking Tests | | | | | | | | | |
| Viscosity, cp @ 100° F. | | | | | | | | | |
| Before | 3,695 | 81,900 | >1,000,000 | 1,379 | 1,070 | 700,000 | 100,000 | 10,700 | 11,472 |
| After | 31 | 1,000 | 55 | 6 | 89 | 77 | 233 | 233 | 220 |
| Ratio | 112 | 82 | 18,000 | 246 | 289 | 9,090 | 429 | 486 | 52 |
| Gravity, °API | | | | | | | | | |
| Before | 13 | 7 | 0 | 16.3 | 12.8 | 8.7 | 6.8 | 9.9 | 10.6 |
| After | 18.6 | 12.5 | 10.7 | 23.7 | 15.4 | 15.3 | 17.9 | 19.7 | 14.8 |
| Increase | 6.0 | 5.5 | 10.7 | 7.4 | 2.6 | 6.6 | 11.1 | 9.8 | 3.8 |
| Sulfur, wt % | | | | | | | | | |
| Before | 1.2 | 1.5 | 7.9 | 0.3 | 0.4 | 3.8 | 3.9 | 4.7 | 3.6 |
| After | 0.9 | 1.3 | 4.8 | 0.2 | 0.4 | 2.5 | 2.8 | 2.2 | 3.8 |
| % Reduction | 29 | 13 | 38 | 33 | 0 | 35 | 29 | 53 | 0 |
| Carbon/Hydrogen Ratio, wt/wt | | | | | | | | | |
| Before | 7.5 | 7.8 | 9.8 | 8.3 | 7.2 | 8.1 | 7.9 | 7.6 | 8.8 |
| After | 7.4 | 7.8 | 8.5 | 7.6 | 7.0 | 8.0 | 7.6 | N/A | 7.3 |

In most cases the results shown in Table 2 are from single runs, except for the San Miguel results which are the averages of seven runs. From the multiple San Miguel runs, data uncertainties expressed as standard deviation of a single result were found to be 21 cp for viscosity, 3.3 API degrees for gravity, 0.5 wt % for sulfur content, and 0.43 for C/H ratio. Comparing these levels of uncertainty with the magnitude of the values measured, it is clear that the improvements in product quality from hydrovisbreaking listed in Table 2 are statistically significant even though the conditions under which these experiments were conducted are at the lower end of the range of conditions specified for this invention, especially with regards to temperature and reaction residence time.

EXAMPLE II

Hydrovisbreaking Increases Yield of Upgraded Hydrocarbons Compared to Conventional Thermal Cracking Example II illustrates the advantage of hydrovisbreaking over conventional thermal cracking. During the thermal cracking of heavy hydrocarbons coke formation is suppressed and the yield of light hydrocarbons is increased in the presence of hydrogen, as is the case in the hydrovisbreaking process.

TABLE 3

Thermal Cracking of a Heavy Crude Oil in the Presence and Absence of Hydrogen (Example II)

| Gas Atmosphere | Hydrogen | Nitrogen |
|---|---|---|
| Pressure cylinder charge, grams | | |
| Sand | 500 | 500 |
| Water | 24 | 24 |
| Heavy crude oil | 501 | 500 |
| Process conditions | | |
| Residence time, hours | 72 | 72 |
| Temperature, ° F. | 650 | 650 |
| Total pressure, psi | 2,003 | 1,990 |
| Gas partial pressure, psi | 1,064 | 1,092 |
| Products, grams | | |
| Light (thermally cracked) oil | 306 | 208 |
| Heavy oil | 148 | 152 |
| Residual carbon (coke) | 8 | 30 |
| Gas (by difference) | 39 | 110 |

The National Institute of Petroleum and Energy Research conducted bench-scale experiments on the thermal cracking of heavy hydrocarbons [Reference 7]. One test on heavy crude oil from the Cat Canyon reservoir incorporated approximately the reservoir conditions and process conditions of in situ hydrovisbreaking. A second test was conducted under nearly identical conditions except that nitrogen was substituted for hydrogen.

Test conditions and results are summarized in Table 3. The hydrogen partial pressure at the beginning of the experiment was 1,064 psi. As hydrogen was consumed without replenishment, the average hydrogen partial pressure during the experiment is not known with total accuracy but would have been less than the initial partial pressure. The experiment's residence time of 72 hours is at the low end of the range for in situ hydrovisbreaking, which might be applied for residence times more than 100 times longer.

Although operating conditions were not as severe in terms of residence time as are desired for in situ hydrovisbreaking, the yield of light oil processed in the hydrogen atmosphere was almost 50% greater than the light oil yield in the nitrogen atmosphere, illustrating the benefit of hydrovisbreaking (i.e., non-catalytic thermal cracking in the presence of significant hydrogen partial pressure) in generating light hydrocarbons from heavy hydrocarbons.

EXAMPLE III

Commercial-Scale Application of Synthetic Crude Production Utilizing the Present Invention Example III indicates the viability of integrating in situ hydrovisbreaking with the process of this invention on a commercial scale. The continuous recovery of commercial quantities of San Miguel bitumen is considered.

Bench-scale experiments and computer simulations of the application of in situ hydrovisbreaking to San Miguel bitumen suggest recoveries of about 80% can be realized. The bench-scale experiments referenced in Example II include tests on San Miguel bitumen where an overall liquid hydrocarbon recovery of 79% was achieved, of which 77% was thermally cracked oil. Computer modeling of in situ hydrovisbreaking of San Miguel bitumen (described in Examples IV and V following) predict recoveries after one year's operation of 88 to 90% within inverted 5-spot production patterns of 5 and 7.2 acres [Reference 3]. At a recovery level of 80%, at least 235,000 barrels (Bbl) of hydrocarbon can be produced from a 7.2-acre production pattern in the San Miguel bitumen formation.

A projected material balance is shown in Table 4 for the surface treatment, using the process of the present invention, of 32,000 barrels per day (Bbl/d) of hydrocarbons produced from the San Miguel bitumen deposit by in situ hydrovisbreaking. The material balance indicates that approximately 18,000 Bbl/d of synthetic crude oil would be produced and that approximately 14,000 Bbl/d of residuum would be consumed in a partial oxidation unit to produce fuel gas and hydrogen for the in situ process. Thus, about 45% of the hydrocarbon originally in place would be transformed into marketable product.

These calculations provide a basis for the design of a commercial level of operation. Fifty 7.2-acre production patterns, each with the equivalent of one injection well and one production well, operated simultaneously would provide gross production averaging 32,000 Bbl/d, which would generate synthetic crude oil at the rate of 18,000 Bbl/d with a gravity of approximately 20° API. The projected life of each production pattern is one year, so all injection wells and production wells in the patterns would be replaced annually.

Field tests [References 2,6] and computer simulations [Reference 3] indicate a similar sized operation using steamflooding instead of in Situ hydrovisbreaking would produce 20,000 Bbl/d of gross production, some three-quarters of which would be consumed at the surface in steam generation, providing net production of 5,000 Bbl/d of a liquid hydrocarbon having an API gravity, after surface processing, of about 10°.

EXAMPLE IV

Process Concept Demonstration by Computer Modeling of In Situ Hydrovisbreaking of San Miguel Bitumen Computer simulations of the in situ hydrovisbreaking process for the San Miguel reservoir were performed using a state-of-the-art reservoir simulation program. The program

TABLE 4

Projected Material Balance: Production of 18,000 Bb1/d of Syncrude from San Miguel Bitumen (Example III)

| Component/ lbs/hr | Raw Crude Water & Gas | Dewatered Crude | C4–C5 Product | Production Water | Recycle H2, C1–C3 H2S | Distillation Product | Not Crude Product | Resid Feed to P.O. | P.O. Synges Product |
|---|---|---|---|---|---|---|---|---|---|
| H2 | 7606 | 0 | 0 | 0 | 7606 | 0 | 0 | 0 | 19339 |
| CO | 0 | 0 | 0 | 0 | 0 | 0 | 0 | 0 | 372278 |
| CO2 | 0 | 0 | 0 | 0 | 0 | 0 | 0 | 0 | 53183 |
| H2S | 17826 | 0 | 0 | 0 | 17826 | 0 | 0 | 0 | 15596 |
| O2 | 0 | 0 | 0 | 0 | 0 | 0 | 0 | 0 | 0 |
| N2 | 0 | 0 | 0 | 0 | 0 | 0 | 0 | 0 | 12634 |
| H2O | 213199 | 0 | 0 | 213199 | 0 | 0 | 0 | 0 | 0 |
| NH3 | 423 | 0 | 0 | 423 | 0 | 0 | 0 | 0 | 0 |
| C1–C3 | 4069 | 0 | 0 | 0 | 4069 | 0 | 0 | 0 | 2176 |
| C4 | 2083 | 0 | 2083 | 0 | 0 | 0 | 2083 | 0 | 0 |
| C5–400 | 19909 | 19909 | 0 | 0 | 0 | 19909 | 19909 | 0 | 0 |
| 400–650 | 39092 | 39092 | 0 | 0 | 0 | 39092 | 39092 | 0 | 0 |
| 850–975 | 160196 | 160196 | 0 | 0 | 0 | 160196 | 160196 | 0 | 0 |
| 975+ | 246082 | 246082 | 0 | 0 | 0 | 23682 | 23682 | 222400 | 0 |
| Solids | 176 | 176 | 0 | 0 | 0 | 0 | 0 | 176 | |
| Total, lbs/hr | 710663 | 465456 | 2083 | 213622 | 29502 | 242880 | 244963 | 222576 | 475204 |
| Liquid, BPD | 48921 | 32000 | 243 | 14678 | | 17819 | 18062 | 14181 | |
| Gas, MM SCFD | 41 | | | | 41 | | | | 229 |
| Liquid Gravity, API | 9.3 | 9.9 | 108.2 | | | 19.3 | 20.0 | −0.5 | |
| Sulfur. wt % | 5.4 | 4.6 | 0.0 | | | 2.8 | 2.8 | 6.6 | |
| Nitrogen, wt % | 0.25 | 0.30 | 0.00 | | | 0.20 | 0.20 | 0.41 | |
| Metals, wt ppm | 96 | 147 | 2 | | | 107 | 106 | 191 | |

TABLE 4-continued

Projected Material Balance:
Production of 18,000 Bb1/d of Syncrude from San Miguel Bitumen
(Example III)

| Metals tpd | 0.8 | 0.8 | 0.0 | | | | 0.3 | 0.3 | 0.5 | |
|---|---|---|---|---|---|---|---|---|---|---|
| | Oxygen | Oxygen | Hydrogen | Steam | | BFW to | By-Products | | | |
| Component/ lbs/hr | to to P.O. | to injection | to injection | to injection | Fuel Gas | Steam Prod. | Metals V, Ni | Nitro-gen | Sulfur | CO2 |
| H2 | 0 | 0 | 19733 | 0 | 16212 | 0 | 0 | 0 | | 0 |
| CO | 0 | 0 | 197 | 0 | 246080 | 0 | 0 | 0 | | 0 |
| CO2 | 0 | 0 | 0 | 0 | 0 | 0 | 0 | 0 | | 251183 |
| H2S | 0 | 0 | 0 | 0 | 0 | 0 | 0 | 0 | | 0 |
| O2 | 240037 | 45289 | 0 | 0 | 0 | 0 | 0 | 0 | | 0 |
| N2 | 12634 | 2384 | 0 | 0 | 0 | 0 | 0 | 570653 | | 0 |
| H2O | 0 | 0 | 0 | 2500000 | 0 | 3125000 | 0 | 0 | | 0 |
| NH3 | 0 | 0 | 0 | 0 | 0 | 0 | 0 | 0 | | 0 |
| C1–C3 | 0 | 0 | 0 | 0 | 0 | 0 | 0 | 0 | | 0 |
| C4 | 0 | 0 | 0 | 0 | 0 | 0 | 0 | 0 | | 0 |
| C5–400 | 0 | 0 | 0 | 0 | 0 | 0 | 0 | 0 | | 0 |
| 400–650 | 0 | 0 | 0 | 0 | 0 | 0 | 0 | 0 | | 0 |
| 850–975 | 0 | 0 | 0 | 0 | 0 | 0 | 0 | 0 | | 0 |
| 975+ | 0 | 0 | 0 | 0 | 0 | 0 | 0 | 0 | | 0 |
| Solids | | | | | | | | | | |
| Total, lbs/hr | 252671 | 47673 | 19931 | 2500000 | 262292 | 3125000 | 43 | 570653 | 32887 | 251183 |
| Liquid, BPD | | | | | | | | | 430 tpd | |
| Gas, MM SCFD | 72 | 14 | 90 | | 154 | | | 186 | | 52 |
| Liquid Gravity, API | | | | | | | | | | |
| Sulfur. wt % | | | | | | | | | | |
| Nitrogen, wt % | | | | | | | | | | |
| Metals, wt ppm | | | | | | | | | | |
| Metals tpd | | | | | | | 1 | | | |

used for these simulations has been employed extensively to evaluate thermal processes for oil recovery such as steam injection and in situ combustion. The simulator uses a mathematical model of a three-dimensional reservoir including details of the oil-bearing and adjacent strata. Any number of components may be included in the model, which also incorporates reactions between components. The program rigorously maintains an accounting of mass and energy entering and leaving each calculation block. The San Miguel-4 Sand, the subject of the simulation, is well characterized in the literature from steamflooding demonstrations previously conducted by CONOCO. Simulation of hydrocracking and upgrading reactions were based on data for the hydrovisbreaking reactions, including stoichiometry and kinetics, obtained in bench-scale experiments by World Energy Systems and in refinery-scale conversion processes, adjusted for the conditions of in situ conversion. Simplified models of chemical reactions and kinetics for hydrogenation of the bitumen were provided to simulate the hydrovisbreaking process. The reaction model did not include potential coking reactions; however, the temperatures employed and the hydrogen mole fraction, which was increased to 0.90, were expected to limit significant levels of coke formation.

The results of the evaluation provide preliminary confirmation of the validity of the invention by demonstrating conversion of crude at in situ conditions and excellent recovery of the upgraded crude. The simulation also included thermal effects and demonstrated that the subsurface reservoir can be raised to the desired reaction temperatures without excessive heat losses to surrounding formations or undesirable losses of reducing gases and steam. Simulation cases testing the application of the process using a cyclic operating mode and a single well in a radial geometry showed that injection of steam and hydrogen into the San Miguel reservoir can only occur at very low rates because of the high bitumen viscosity and saturation which provide an effective seal. All simulations attempted of the cyclic operation resulted in low recoveries of bitumen because of the inability to inject heat in the form of steam and hot hydrogen at adequate rates. Cyclic operation of the in situ hydrovisbreaking process on other resources may be successfully implemented. For example, the successful cyclic steam injection operations at ESSO's Cold Lake project in Alberta, Canada, and the Orinoco crude projects in Venezuela could be converted to an in situ hydrovisbreaking operation as disclosed by this invention.

The low injectivity of the San Miguel reservoir was overcome by the creation of a simulated horizontal fracture within the formation in conjunction with the use of a continuous injection process which modeled an inverted 5-spot operation comprising a central injection well and four production wells at the corners of a square production area of 5 or 7.2 acres. The first step in the continuous process was the formation of a horizontal fracture linking the injection and production wells and allowing efficient injection of steam and hydrogen. A similar fracture operation was successfully used by CONOCO in their steamflood field demonstrations. Following fracture formation, steam was injected for a period of approximately thirty days to preheat the reservoir to about 600° F. A mixture of steam and heated hydrogen was then continuously injected into the central injection well for a total process duration of 80 to 360 days while formation water, gases, and upgraded hydrocarbons were produced from the four production wells.

The continuous operating mode produced excellent results and predicted high conversions of the in situ bitumen with attendant increases in API gravity and high recovery levels of upgraded heavy hydrocarbons. Using the hydrovisbreaking process of this invention, total projected recoveries up to 90 percent of the bitumen in the production area were achieved in less than one year, while the API gravity of the in situ bitumen gravity was increased to the 10 to 15°

API range from 0° API. Results of three of the continuous-injection simulations are summarized in Table 5 below, along with a base-case simulation illustrating the result of steam injection only. Table 5 shows the predicted conversion of the in situ bitumen and the recoveries of the converted, unconverted, and virgin or native bitumen.

The amount of bitumen recovered in the Base Case (129,000 Bbl), which simulated injection of steam only, was comparable to the amount reported recovered (110,000 Bbl) by CONOCO in their field test conducted in the San Miguel-4 Sand on the Street Ranch property. The Base Case replicated as closely as possible the conditions of the CONOCO field test. The crude recovery, run duration, and injection/production method simulated in the steam-only case approximated the methods and results of the CONOCO field experiments providing preliminary verification of the overall validity of the results.

TABLE 5

Computer Simulation of In Situ Hydrovisbreaking (Example IV)

| Simulation Case | Base | A | B | C |
|---|---|---|---|---|
| Pattern Size, acres | 5 | 5 | 5 | 7.2 |
| Simulation Time, days | 360 | 79 | 360 | 300 |
| Injection Temperature, ° F. | | | | |
| Steam | 600 | 600 | 600 | 600 |
| Hydrogen | N/A | 1,000 | 1,000 | 1,000 |
| Injected Volume | | | | |
| Steam, Bbl (CWE)[1] | 1,440,000 | 592,100 | 982,300 | 1,182,000 |
| Hydrogen, Mcf | 0 | 782,400 | 1,980,000 | 2,333,000 |

TABLE 5-continued

Computer Simulation of In Situ Hydrovisbreaking (Example IV)

| Simulation Case | Base | A | B | C |
|---|---|---|---|---|
| Cumulative Production, Bbl | 129,000 | 174,780 | 238,590 | 335,470 |
| Oil Recovery, % OOIP[2] | 48.6 | 65.8 | 89.9 | 87.7 |
| In Situ Upgrading, API° | 0 | 10.0 | 15.3 | 14.7 |
| 975° F. Conversion, vol % | 0 | 34.3 | 51.8 | 49.3 |
| Gravity of Produced Oil, °API | 0 | 10.0 | 15.3 | 14.7 |

[1]Cold water equivalents

[2]Original oil in place

Figure 5:
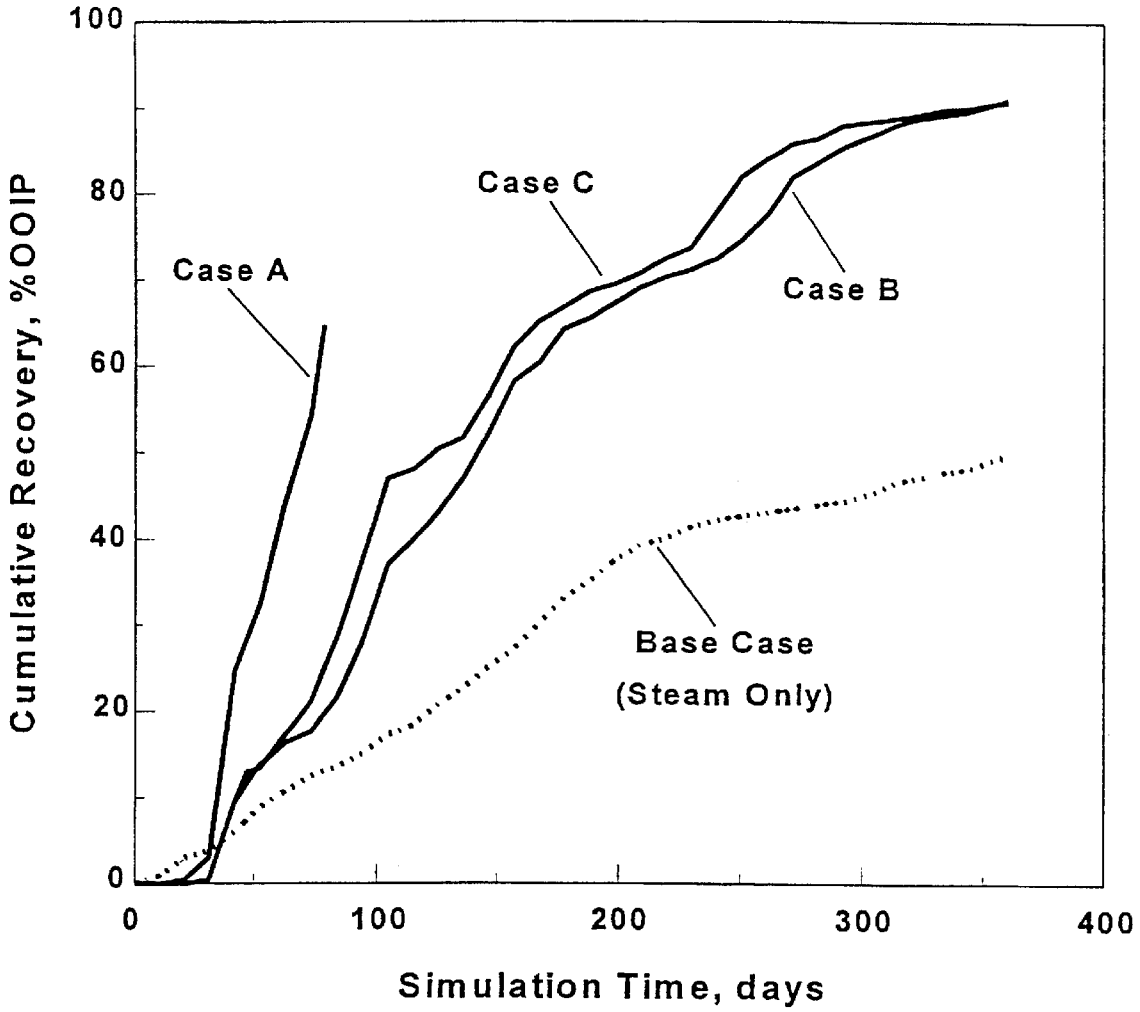
FIG. 5 is a graph showing the recovery of oil in three cases A, B, and C using in situ hydrovisbreaking compared with a Base Case in which only steam was injected into the reservoir. The production patterns of the Base Case and of Cases A and B encompass 5 acres. The production pattern of Case C encompasses 7.2 acres.

As shown in FIG. 5, the oil recoveries obtained in Cases A, B, and C are significantly higher than the 48.6 percent recovery obtained in the steam-only case. Most importantly, the oil produced in the steamflood case did not experience the upgrading achieved in the hydrovisbreaking cases.

EXAMPLE V

Advantages of Increased Operating Severity

Example V teaches the advantages of increasing in situ operating severity to eliminate residuum from the produced hydrocarbons and improve the overall quality of the syn-crude product.

TABLE 6

Effects of Reaction Time and Hydrogen Concentration on Process Results (Example V)

| Operation | Short Reaction Time | Increased Reaction Time | Low Hydrogen Concentration | High Hydrogen Concentration |
|---|---|---|---|---|
| Production Period, days | 79 | 360 | 300 | 300 |
| Hydrogen, mole fraction | 0.23 | 0.23 | 0.23 | 0.80 |
| Injection Temperature, ° F. | | | | |
| Steam | 600 | 600 | 600 | 600 |
| Gas | 1,000 | 1,000 | 1,000 | 1,000 |
| Cum. Production, MBbl | 175 | 239 | 335 | 344 |
| Oil Recovery, % OOIP | 65.8 | 89.9 | 87.7 | 90.0 |
| 975° F. Conversion, % | 34.3 | 51.8 | 49.3 | 50 |
| In Situ Upgrading, API° | 10.0 | 15.3 | 14.7 | 15 |
| Syncrude Properties | | | | |

TABLE 6-continued

Effects of Reaction Time and Hydrogen Concentration on Process Results (Example V)

| Operation | Short Reaction Time | Increased Reaction Time | Low Hydrogen Concentration | High Hydrogen Concentration |
|---|---|---|---|---|
| After Surface Processing | | | | |
| Gravity, °API | 19.5 | 26.8 | 26.8 | 27 |
| Sulfur, wt % | 3.15 | 1.98 | 1.98 | 1.6 |
| Nitrogen, wt % | 0.17 | 0.16 | 0.16 | 0.12 |
| Metals, wppm | <5 | 0 | 0 | 0 |
| $C_4$-975° F., vol % | 89.3 | 100 | 100 | 100 |
| 975° F.+, vol % | 10.7 | 0 | 0 | 0 |
| End Point, ° F. | >975 | 910 | 945 | 900 |

The data shown in Table 6 for the first three operations are, respectively, based on Cases A, B, and C from the computer simulations of Example IV. The final operation is a projected case based on the known effects of increased hydrogen partial pressure in conventional hydrovisbreaking operations. The first two cases suggest the effects of residence time on product quality, total production, oil recovery, and energy efficiency. The final case projects the beneficial effect of increasing hydrogen partial pressure on product quality. Not shown is the additional known beneficial effects on product quality resulting from reduced levels of unsaturates in the syncrude product. Increasing hydrogen concentration in the injected gas also decreases the potential for coke formation, as was illustrated in Example II.

EXAMPLE VI

Benefits of Utilizing Residuum Fraction for Process Requirements

Example VI shows the benefits of utilizing the heavy residuum (the nominal 975°+ fraction) that is isolated during the processing of the syncrude product for internal energy and fuel requirements.

TABLE 7

Benefits of Residuum Removal from a Produced Heavy Hydrocarbon Computer-Simulated Production of San Miquel Bitumen by Conventional Steam Drive (Example VI)

| Properties | Produced Hydrocarbon Without Residuum Removal | Produced Hydrocarbon With Residuum Removal |
|---|---|---|
| Gravity, °API | 0 | 10.4 |
| Sulfur, wt % | 7.9 | 4.5 |
| Nitrogen, wt % | 0.36 | 0.23 |
| Metals, (Vanadium/Nickel), wppm | 85/24 | <5/5 |
| 975° F. + fraction, vol % | 71.5 | 17.6 |

Table 7 lists the properties of San Miguel bitumen after simulated production by steam drive without the removal of the residuum fraction from the final liquid hydrocarbon product as well as the estimated properties after residuum removal. Removal of the residuum results in improved gravity; reduced levels of sulfur, nitrogen, and metals; and a major drop in the residuum content of the final product.

As in Example IV, a comprehensive, three-dimensional reservoir simulation model was used to conduct the simulation in this example and the simulations in Example VII. The model solves simultaneously a set of convective mass transfer, convective and conductive heat transfer, and chemical-reaction equations applied to a set of grid blocks representing the reservoir. In the course of a simulation, the model rigorously maintains an accounting of the mass and energy entering and leaving each grid block. Any number of components may be included in the model, as well as any number of chemical reactions between the components. Each chemical reaction is described by its stoichiometry and reaction rates; equilibria are described by appropriate equilibrium thermodynamic data.

Reservoir properties of the San Miguel bitumen formation, obtained from Reference 6, were used in the model. Chemical reaction data in the model were based on the bench-scale hydrovisbreaking experiments with San Miguel bitumen presented in Example I and on experience with conversion processes in commercial refineries.

EXAMPLE VII

Advantages of the ISHRE Process Compared to Steam Drive

Example VII teaches the advantages of the increased upgrading and recovery which occur when a heavy hydrocarbon is produced by in situ hydrovisbreaking rather than by steam drive. The results of the two computer simulations are summarized in Table 8.

The tabulated results labeled "Steam Drive" and "ISHRE Process" correspond to the plots of hydrocarbon recovery versus production time labeled "Base Case and "Case B" in FIG. 5 of the drawings. Table 8 shows the superior properties of the syncrude product and the improved recovery realized from in situ hydrovisbreaking. In addition, in situ hydrovisbreaking is more energy efficient than steam drive-more oil is recovered in less time, and the fraction of gross-production-to-product from in situ hydrovisbreaking is almost twice that of gross-production-to-product from steam drive.

TABLE 8

ISHRE Process Compared to Steam Drive (Example VII)

| Operating Mode | Continuous Steam Drive | Continuous ISHRE Process |
|---|---|---|
| Days of Operation | 360 | 360 |
| Injection Temperature, ° F. | | |
| Steam | 600 | 600 |
| Hydrogen | — | 1,000 |
| Cumulative Injection | | |
| Steam, barrels (cold water equivalents) | 1,440,000 | 982,000 |
| Hydrogen, Mcf | 0 | 1,980,000 |
| Cumulative Hydrocarbon Production, barrels | 129,000 | 239,000 |
| Hydrocarbon Recovery, % OOIP | 48.6 | 89.9 |
| In Situ Upgrading, ΔAPI degrees | 0 | 15.3 |
| Syncrude Properties (after surface processing) | | |
| Gravity, °API | 10.4 | 26.8 |
| Sulfur, wt % | 4.5 | 2.0 |
| Metals (Vanadium/Nickel), wppm | <5/5 | 0/0 |
| $C_4$ - 975° F. fraction | | |
| Volume, % | 82.4 | 100 |
| Gravity, °API | 14.2 | 26.8 |
| 975° F. + fraction | | |
| Volume, % | 17.6 | 0.0 |
| Gravity, °API | −5.0 | — |
| Fraction of Gross Production | | |
| To Product | 0.33 | 0.70 |
| To Gasifier | 0.67 | 0.30 |

EXAMPLE VIII

Application of ISHRE Technology to Various Hydrocarbon Resources

Example VIII illustrates and teaches that the ISHRE process presents opportunities for utilization of heavy crudes and bitumens which may otherwise not be economically recoverable.

TABLE 9

Product Quality of Hydrocarbons Before, During, and After Application of the ISHRE Process (Example VIII)

| Hydrocarbon Properties | Unconverted Hydrocarbon | Produced After Hydrovisbreaking | Syncrude After 975° F. + Removal |
|---|---|---|---|
| San Miguel | | | |
| Gravity, °API | −2 to 0 | 15.0 | 26.8 |
| Sulfur, wt % | 7.9 | 4.5 | 1.98 |
| Nitrogen, wt % | 0.36 | 0.26 | 0.16 |
| Metals (V/Ni), wppm | 85/24 | 85/24 | <1/1 |
| 975° F.+, vol % | 71.5 | 35.4 | 0 |
| Viscosity, cp @ 100° F. | >1,000,000 | 9 | |
| Orinoco-Cerro Negro | | | |
| Gravity, °API | 8.2 | 16.5 | 23.3 to 24.0 |
| Sulfur, wt % | 3.8 | 2.7 | <1.66 |
| Nitrogen, wt % | 0.64 | 0.055 | <0.24 |

TABLE 9-continued

Product Quality of Hydrocarbons Before, During, and After Application of the ISHRE Process (Example VIII)

| Hydrocarbon Properties | Unconverted Hydrocarbon | Produced After Hydrovisbreaking | Syncrude After 975° F. + Removal |
|---|---|---|---|
| Metals (V/Ni), wppm | 454/105 | 454/105 | <1/1 |
| 975° F.+, vol % | 59.5 | 29.8 | 0 |
| Viscosity, cp @ 100° F. | 7,000 | 25 | |
| Cold Lake | | | |
| Gravity, °API | 11.4 | 19.7 | 25.6 to 26.6 |
| Sulfur, wt % | 4.3 | 2.2 | <1.5 |
| Nitrogen, wt % | 0.4 | 0.35 | <0.16 |
| Metals (V/Ni), wppm | 189/76 | 189/76 | <1/1 |
| 975° F.+, vol % | 51 | 28.3 | 0 |
| Viscosity, cp @ 100° F. | 10,700 | 233 | |

Summarized in Table 9 are product inspections for syncrude produced by ISHRE technology from San Miguel bitumen and from two other extensive deposits of heavy crude oil: Orinoco and Cold Lake. More detailed product characteristics of the produced crude with the estimated quality of the 975° F.− and 975° F.+ fractions are shown in Table 10 for Orinoco crude and in Table 11 for Cold Lake crude.

The weight balances appearing in these tables are based on unconverted fresh feed and the chemical hydrogen requirements for the in situ hydrovisbreaking reaction.

Other heavy hydrocarbons—such as those having properties similar to the crudes and bitumens in the Unita Basin, Circle Cliffs, and Tar Sands Triangle deposits of Utah—are also candidates for the ISHRE process.

TABLE 10

Estimated Properties of the Orinoco Produced Crude Fractions after Hydrovisbreaking (Example VIII)

| Product Cuts | Product Fractions wt %(1) | Product Fractions vol % | Gravity °API | Sulfur wt % | Nitrogen wt % | V/Ni wppm |
|---|---|---|---|---|---|---|
| Produced Crude | | | | | | |
| $C_1$–$C_3$ | 0.83 | | | | | |
| $C_4$ | 0.29 | 0.5 | | | | |
| $C_5$-400° F. | 5.84 | 7.5 | 47.4 | 0.5 | 0.03 | |
| 400–650° F. | 21.40 | 24.7 | 29.7 | 1.0 | 0.11 | |
| 650–975° F. | 39.46 | 41.5 | 15.4 | 2.2 | 0.35 | |
| 975° F+ | 31.13 | 29.8 | 2.0 | 5.0 | 1.22 | |
| Total | 100.77 | 104.0 | 16.5 | | | |
| Fractionator Products | | | | | | |
| 975° F.+(2) | | 29.8 | 2.0 | 5.0 | 1.22 | 1,458/337 |
| 975° F.−(3) | | 74.2 | 23.3 | 1.7 | 0.24 | <1/1 |

(1)Wt % of fresh feed; i.e., unconverted bitumen
(2)Feed to the partial oxidation unit
(3)Product available for shipment

TABLE 11

Estimated Properties of the Cold Lake Produced Crude Fractions after Hydrovisbreaking (Example VIII)

| Product Cuts | Product Fractions wt %[1] | Product Fractions vol % | Gravity °API | Sulfur wt % | Nitrogen wt % | V/Ni wppm |
|---|---|---|---|---|---|---|
| | | Produced Crude | | | | |
| $C_1$–$C_3$ | 0.71 | | | | | |
| $C_4$ | 0.47 | 0.8 | | | | |
| $C_5$- 400° F. | 5.60 | 7.3 | 54.5 | 0.5 | 0.01 | |
| 400–650° F. | 18.91 | 21.8 | 33.2 | 1.1 | 0.05 | |
| 650–975° F. | 42.70 | 44.1 | 17.9 | 1.9 | 0.30 | |
| 975° F.+ | 29.41 | 28.3 | 6.0 | 3.8 | 0.65 | |
| Total | 100.79 | 102.3 | 19.7 | 2.1 | | |
| | | Fractionator Products | | | | |
| 975° F.+[2] | | 28.3 | 6.0 | 3.8 | 0.65 | 629/253 |
| 975° F.–[3] | | 74.0 | 25.9 | 1.5 | 0.20 | <1/1 |

[1]Wt % of fresh feed; i.e., unconverted bitumen
[2]Feed to the partial oxidation unit
[3]Product available for shipment

We claim:

1. An integrated process for continuously converting, upgrading, and recovering heavy hydrocarbons from a subsurface formation and for treating, at the surface, production fluids recovered by injecting steam and reducing gases into said subsurface formation—said production fluids being comprised of converted liquid hydrocarbons, unconverted virgin heavy hydrocarbons, reducing gases, hydrocarbon gases, solids, water, hydrogen sulfide, and other components—to provide a synthetic-crude-oil product, and said integrated process comprising the steps of:

a. inserting a downhole combustion unit into at least one injection borehole which communicates with at least one production borehole, said downhole combustion unit being placed at a position within said injection borehole in proximity to said subsurface formation;

b. flowing from the surface to said downhole combustion unit within said injection borehole a set of fluids—comprised of steam, reducing gases, and oxidizing gases—and burning at least a portion of said reducing gases with said oxidizing gases in said downhole combustion unit;

c. injecting a gas mixture—comprised of combustion products from the burning of said reducing gases with said oxidizing gases, residual reducing gases, and steam—from said downhole combustion unit into said subsurface formation;

d. recovering from said production borehole, production fluids comprised of converted and unconverted hydrocarbons, as well as residual reducing gases, and other components;

e. at the surface, treating said production fluids to recover thermal energy via heat transfer operations and to separate produced solids, reducing gases, hydrocarbon gases, and upgraded liquid hydrocarbons comprised of said converted liquid hydrocarbons and said unconverted heavy hydrocarbons;

f. distilling said upgraded liquid hydrocarbons to produce a light fraction comprising a synthetic crude oil ("syncrude") product and a heavy residuum fraction;

g. in a partial oxidation unit, carrying out partial oxidation of said heavy residuum fraction to produce a raw synthesis-gas stream;

h. carrying out gas-treating operations on said raw synthesis-gas stream—comprising the removal of solids, hydrogen sulfide, carbon dioxide, and other components—to produce a clean reducing-gas mixture and a fuel gas;

i. carrying out treating operations on the hydrocarbon gases and reducing gases of step e to remove water, hydrogen sulfide, and other undesirable components and to separate hydrocarbon gases and reducing gases;

j. combining said reducing gases of steps h and i to produce a composite reducing-gas mixture for injection into said subsurface formation;

k. in a steam plant, generating partially saturated steam for injection into said subsurface formation, using as fuel said fuel gas of step h and said separated hydrocarbon gases of step i;

l. continuing steps a through k until the recovery of said heavy hydrocarbons within said subsurface formation is essentially complete or until the rate of recovery of the heavy hydrocarbons is reduced below a level of economic operation.

2. An integrated process for cyclically converting, upgrading, and recovering heavy hydrocarbons from a subsurface formation and for treating, at the surface, production fluids recovered by injecting steam and reducing gases into said subsurface formation—said production fluids being comprised of converted liquid hydrocarbons, unconverted virgin heavy hydrocarbons, reducing gases, hydrocarbon gases, solids, water, hydrogen sulfide, and other components—to provide a synthetic-crude-oil product, and said integrated process comprising the steps of:

a. inserting a downhole combustion unit into at least one injection borehole, said downhole combustion unit being placed at a position within said injection borehole in proximity to said subsurface formation;

b. for a first period, flowing from the surface to said downhole combustion unit within said injection borehole a set of fluids—comprised of steam, reducing gases, and oxidizing gases—and burning at least a portion of said reducing gases with said oxidizing gases in said downhole combustion unit;

c. injecting a gas mixture—comprised of combustion products from the burning of said reducing gases with said oxidizing gases, residual reducing gases, and steam—from said downhole combustion unit into said subsurface formation;

d. for a second period, upon achieving a preferred temperature within said subsurface formation, halting injection of fluids into the subsurface formation while maintaining pressure on said injection borehole to allow time for a portion of said heavy hydrocarbons in the subsurface formation to be converted into lighter hydrocarbons;

e. for a third period, reducing the pressure on said injection borehole, in effect converting the injection borehole into a production borehole, and recovering at the surface production fluids, comprised of converted and unconverted hydrocarbons, as well as residual reducing gases, and other components;

f. at the surface, treating said production fluids to recover thermal energy via heat transfer operations and to separate produced solids, reducing gases, hydrocarbon gases, and upgraded liquid hydrocarbons comprised of said converted liquid hydrocarbons and said unconverted heavy hydrocarbons;

g. distilling said upgraded liquid hydrocarbons to produce a light fraction comprising a synthetic crude oil ("syncrude") product and a heavy residuum fraction;

h. in a partial oxidation unit, carrying out partial oxidation of said heavy residuum fraction to produce a raw synthesis-gas stream;

i. carrying out gas-treating operations on said raw synthesis-gas stream—comprising the removal of solids, hydrogen sulfide, carbon dioxide, and other components—to produce a clean reducing-gas mixture and a fuel gas;

j. carrying out treating operations on the hydrocarbon gases and reducing gases of step f to remove water, hydrogen sulfide, and other undesirable components and to separate hydrocarbon gases and reducing gases;

k. combining said reducing gases of steps i and j to produce a composite reducing-gas mixture for injection into said subsurface formation;

l. in a steam plant, generating partially saturated steam for injection into said subsurface formation, using as fuel said fuel gas of step i and said separated hydrocarbon gases of step j;

m. repeating steps b through e to expand the volume of said subsurface formation processed for the recovery of said heavy hydrocarbons and continuing steps f through l to treat said production fluids until the recovery rate of said heavy hydrocarbons within said subsurface formation in the vicinity of said injection borehole is below a level of economic operation.

3. An integrated process for cyclically—followed by continuously—converting, upgrading, and recovering heavy hydrocarbons from a subsurface formation and for treating, at the surface, production fluids recovered by injecting steam and reducing gases into said subsurface formation—said production fluids being comprised of converted liquid hydrocarbons, unconverted virgin heavy hydrocarbons, reducing gases, hydrocarbon gases, solids, water, hydrogen sulfide, and other components—to provide a synthetic-crude-oil product, and said integrated process comprising the steps of:

a. inserting downhole combustion units into at least two injection boreholes, said downhole combustion units being placed at a position within said injection boreholes in proximity to said subsurface formation;

b. for a first period, flowing from the surface to said downhole combustion units within said injection boreholes a set of fluids—comprised of steam, reducing gases, and oxidizing gases—and burning at least a portion of said reducing gases with said oxidizing gases in said downhole combustion units;

c. injecting a gas mixture—comprised of combustion products from the burning of said reducing gases with said oxidizing gases, residual reducing gases, and steam—from said downhole combustion units into said subsurface formation;

d. for a second period, upon achieving a preferred temperature within said subsurface formation, halting injection of fluids into the subsurface formation while maintaining pressure on said injection boreholes to allow time for a portion of said heavy hydrocarbons in the subsurface formation to be converted into lighter hydrocarbons;

e. for a third period, reducing the pressure on said injection boreholes, in effect converting the injection boreholes into production boreholes, and recovering at the surface production fluids, comprised of converted and unconverted hydrocarbons, as well as residual reducing gases, and other components;

f. at the surface, treating said production fluids to recover thermal energy via heat transfer operations and to separate produced solids, reducing gases, hydrocarbon gases, and upgraded liquid hydrocarbons comprised of said converted liquid hydrocarbons and said unconverted heavy hydrocarbons;

g. distilling said upgraded liquid hydrocarbons to produce a light fraction comprising a synthetic crude oil ("'syncrude") product and a heavy residuum fraction;

h. in a partial oxidation unit, carrying out partial oxidation of said heavy residuum fraction to produce a raw synthesis-gas stream;

i. carrying out gas-treating operations on said raw synthesis-gas stream—comprising the removal of solids, hydrogen sulfide, carbon dioxide, and other components—to produce a clean reducing-gas mixture and a fuel gas;

j. carrying out treating operations on the hydrocarbon gases and reducing gases of step f to remove water, hydrogen sulfide, and other undesirable components and to separate hydrocarbon gases and reducing gases;

k. combining said reducing gases of steps i and j to produce a composite reducing-gas mixture for injection into said subsurface formation;

l. in a steam plant, generating partially saturated steam for injection into said subsurface formation, using as fuel said fuel gas of step i and said separated hydrocarbon gases of step j;

m. repeating steps b through e to expand the volume of said subsurface formation processed for the recovery of said heavy hydrocarbons and continuing steps f through l to treat said production fluids until the recovery rate of said heavy hydrocarbons within said subsurface formation in the vicinity of said injection borehole is below a level of practical operation;

n. from at least one injection borehole, removing the downhole combustion unit and permanently converting the borehole to a production borehole;

o. flowing from the surface to the remaining downhole combustion units within the remaining injection boreholes a set of fluids—comprised of steam, reducing gases, and oxidizing gases—and burning at least a portion of said reducing gases with said oxidizing gases in said downhole combustion units;

p. injecting a gas mixture—comprised of combustion products from the burning of said reducing gases with said oxidizing gases, residual reducing gases, and steam—from said downhole combustion units into said subsurface formation;

q. recovering from said production borehole, production fluids comprised of said heavy hydrocarbons, which may be converted to lighter hydrocarbons, as well as residual reducing gases, and other components;

r. continuing steps o, p, and q to recover said production fluids and continuing steps f through l to treat said production fluids until the recovery rate of said heavy hydrocarbons within said subsurface formation in the region between the remaining injection boreholes and said production borehole is reduced below a level of practical operation.

4. The process of claims 1 or 2 or 3 wherein the injection rate, temperature, and composition of said reducing gases and oxidizing gases, and the rate at which said heavy hydrocarbons are collected from said production boreholes, are controlled to obtain the optimum conversion and product quality of the collected heavy-hydrocarbon liquids, and in which the collected heavy-hydrocarbon liquids are comprised of components boiling in the transportation-fuel range ($C_4$ to 650° F.) and the gas-oil range (650 to 975 ° F.), and a residuum fraction which satisfies feed requirements for the partial oxidation plant and the fuel and energy needs of the surface and subsurface operations.

5. The process of claims 1 or 2 or 3 in which the said distillation step is operated to produce a net syncrude product stream which comprises 50 to 75 percent of the gross produced liquid hydrocarbon stream, with the remainder of said gross produced liquid hydrocarbon stream directed to the said partial oxidation operation.

6. The process of claims 1 or 2 or 3 in which supplemental fuels, including crude oil, natural gas, refinery off-gases, coal, hydrocarbon-containing wastes, and hazardous waste materials, are mixed with the said heavy residuum fraction fed to the said partial oxidation unit, thereby reducing the net requirement for heavy residuum in the partial oxidation operation and thereby increasing the net amount of syncrude product generated by the surface operations.

7. The process of claims 1 or 2 or 3 in which a portion of the fuel gas produced in said partial oxidation operation is utilized as fuel for a gas turbine as part of a combined-cycle process to generate electric power as a product of the process.

8. The process of claims 1 or 2 or 3 in which a portion of the fuel gas produced in said partial oxidation operation is utilized as fuel for a steam boiler with a steam-turbine generation unit to generate electric power as a product of the process.

9. The process of claims 1 or 2 or 3 in which the heavy hydrocarbon in said subsurface formation has properties similar to those found in the San Miguel bitumen deposit of south Texas wherein the gravity of the heavy hydrocarbon is in the range of −2 to 0 degrees API, the sulfur content of the heavy hydrocarbon is greater than 8 weight percent, and the heavy hydrocarbon is found in a subsurface formation located at a depth of approximately 1,800 feet.

10. The process of claims 1 or 2 or 3 in which the heavy hydrocarbon in said subsurface formation has properties similar to those found in the Unita Basin, Circle Cliffs, and Tar Sand Triangle deposits of Utah wherein the gravity of the heavy hydrocarbon is in the range of 10 to 14 degrees API, the nitrogen content of the heavy hydrocarbon is in the range or 0.5 to 1.5 weight percent, and the heavy hydrocarbon is found in a subsurface formation located at a depth of approximately 500 feet.

11. The process of claims 1 or 2 or 3 in which the heavy hydrocarbon in the subsurface formation has properties similar to those found in the Cold Lake region of Alberta, Canada, wherein the gravity of the heavy hydrocarbon is in the range of 10 to 12 degrees API, the sulfur content of the heavy hydrocarbon is greater than 4.3 weight percent, the nitrogen content of the heavy hydrocarbon is greater than 0.4 weight percent, the vanadium-plus-nickel metals content of the heavy hydrocarbon is greater than 265 parts per million by weight, and the heavy hydrocarbon is found in a subsurface formation located at a depth of approximately 1,500 feet.

* * * * *